US010287791B1

(12) United States Patent
Krombein

(10) Patent No.: US 10,287,791 B1
(45) Date of Patent: May 14, 2019

(54) VINYL POOL DRAIN COVER ASSEMBLY

(71) Applicant: Todd Krombein, Phoenix, AZ (US)

(72) Inventor: Todd Krombein, Phoenix, AZ (US)

( * ) Notice: Subject to any disclaimer, the term of this patent is extended or adjusted under 35 U.S.C. 154(b) by 10 days.

(21) Appl. No.: 15/413,324

(22) Filed: Jan. 23, 2017

Related U.S. Application Data

(60) Provisional application No. 62/286,275, filed on Jan. 22, 2016.

(51) Int. Cl.
*E04H 4/12* (2006.01)
*E04H 4/14* (2006.01)
*E03F 5/06* (2006.01)

(52) U.S. Cl.
CPC ..... *E04H 4/14* (2013.01); *E03F 5/06* (2013.01); *E04H 4/1236* (2013.01)

(58) Field of Classification Search
CPC ..... E04H 4/1218; E04H 4/1236; E04H 4/14; E04H 4/16; E03F 5/0407; E03F 5/0408; E03F 5/06
USPC .... 210/163, 164, 167.1, 167.16; 4/490, 496, 4/504, 507, 292
See application file for complete search history.

(56) References Cited

U.S. PATENT DOCUMENTS 2,756,078 A * 7/1956 Klingler ..... E03C 1/14 4/292
3,378,858 A * 4/1968 Jacuzzi ..... E04H 4/1236 210/163
4,460,462 A * 7/1984 Arneson ..... E04H 4/1236 210/163
6,397,408 B1 * 6/2002 Veloskey ..... E04H 4/1236 4/292
7,178,179 B2 * 2/2007 Barnes ..... E03C 1/26 4/292
7,996,931 B2 * 8/2011 Plette ..... E04H 4/1236 4/507
8,281,427 B2 * 10/2012 Afshar ..... E04H 4/1236 4/504
2001/0013373 A1 * 8/2001 Wright ..... E04H 4/1236 4/504
2001/0042266 A1 * 11/2001 Schroader ..... E04H 4/1236 4/507
2006/0218714 A1 * 10/2006 Mjelde ..... E04H 4/1236 4/507

* cited by examiner

*Primary Examiner* — Christopher Upton
(74) *Attorney, Agent, or Firm* — Knobbe Martens Olson & Bear LLP

(57) ABSTRACT

A vinyl drain cover assembly for a pool or spa is provided. The drain cover assembly has a vinyl insert that allows the drain cover assembly to blend in visually with the surrounding vinyl liner of the pool or spa. The insert is exchangeable with another insert having a different appearance. The drain cover assembly supports the insert and prevents the insert from being sucked into the drain.

16 Claims, 37 Drawing Sheets

VINYL POOL DRAIN COVER ASSEMBLY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

Certain embodiments discussed herein relate to a drain cover for a pool, spa, or other water feature having a vinyl liner.

Description of the Related Art

In certain regions of the country, vinyl pools are preferred over gunnite concrete or fiberglass pools. The inner surface of vinyl pools, spas, and other water features are covered by a sheet of flexible liner positioned between water and the underlying pool structure, which is often made of pre-manufactured wall panels and supports. Ideal liner materials are impervious to water, aesthetically pleasing, low-cost, and comfortable to touch. Vinyl pools are a popular choice in cold weather regions because of the flexibility of the material which allows the liner to withstand freeze thaw conditions without inducing pool wall cracking. It is also low-cost, quick to install, non-porous, smooth, and does not harbor algae growth. However, a problem with vinyl pools is that the aesthetic appearance of the pool liner can be disrupted by drain covers protruding from the smooth vinyl surface at the bottom of the pool.

SUMMARY

The systems, methods and devices described herein have innovative aspects, no single one of which is indispensable or solely responsible for their desirable attributes. Without limiting the scope of the claims, some of the advantageous features will now be summarized.

In some aspects, a drain cover assembly adapted to be positioned over a drain opening in a pool is disclosed. The drain cover assembly includes a retainer ring, a support plate, and a removable insert. The retainer ring includes an inner rim that circumferentially surrounds a central opening of the retainer ring. The support plate includes a peripheral flange that circumferentially surrounds a central portion of the support plate. The peripheral flange has an outer diameter that is larger than in inner diameter of the central opening of the retainer ring. The removable insert is disposed over the central portion of the support plate and is secured between the support plate and the retainer ring. In some aspects, the support plate further includes a sidewall interposed between the central portion and the peripheral flange of the support plate. In certain aspects, at least a portion of the removable insert is interposed between the inner rim of the retainer ring and the sidewall of the support plate when the drain cover assembly is assembled. In some aspects, the support plate further comprises a base ring that includes a plurality of struts that extend radially inward from the base ring. In certain arrangements, the base ring is adapted to reversibly attach to the retainer ring. In certain variants, the plurality of struts supports the support plate. In some aspects, the support plate is fixedly attached to the plurality of struts.

In certain variants, the drain cover assembly further comprises a floor ring that is adapted to reversibly attach to the retainer ring. The base ring of the support plate is disposed between the floor ring and the retainer ring when the retainer ring is attached to the floor ring. In some aspects, the floor ring includes a plurality of through holes and one or more posts that extend from a top surface of the floor ring. In some aspects, the base ring includes at least one through hole that is sized to allow the post of the floor ring to pass through the at least one through hole of the base ring. In some aspects, the drain cover assembly further includes a top seal and a bottom seal, with each of the top seal and the bottom seal having at least one through hole that is adapted to align with the at least one through hole of the floor ring. In some aspects, the peripheral portion of the insert is secured to one or both of the retainer ring and the support plate by an adhesive. In some variants, the peripheral flange includes one or more pins that are adapted to hold the insert to the peripheral flange. In some aspects, the retainer ring includes an annular groove that has pins adapted to hold the peripheral portion of the flange to the retainer ring.

In some aspects, a method of assembling a drain cover assembly over a drain opening in a pool is disclosed. The method includes covering a cap portion of the drain cover assembly with a vinyl insert. The method further includes placing a retainer ring over the cap portion so that at least a portion of the vinyl insert is disposed between the cap portion and the retainer ring. The method further includes securing the cap portion to the retainer ring. In some aspects, the method further includes securing a floor ring to a sump ring of a pool drain and securing the retainer ring to the floor ring. In some aspects, the method further includes securing a vinyl pool liner between a top seal and a bottom seal, and securing the top seal and the bottom seal between the floor ring and the sump ring of the pool drain.

In some aspects, a kit for a pool drain cover assembly is disclosed. The kit includes a retainer ring, a support plate, and a fastener. The retainer ring has an inner rim that circumferentially surrounds a central opening of the retainer ring. The support plate includes a peripheral flange that circumferentially surrounds a central portion of the support plate. The peripheral flange has an outer diameter that is larger than an inner diameter of the central opening of the retainer ring. The fastener is adapted to secure the support plate to the retainer ring.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
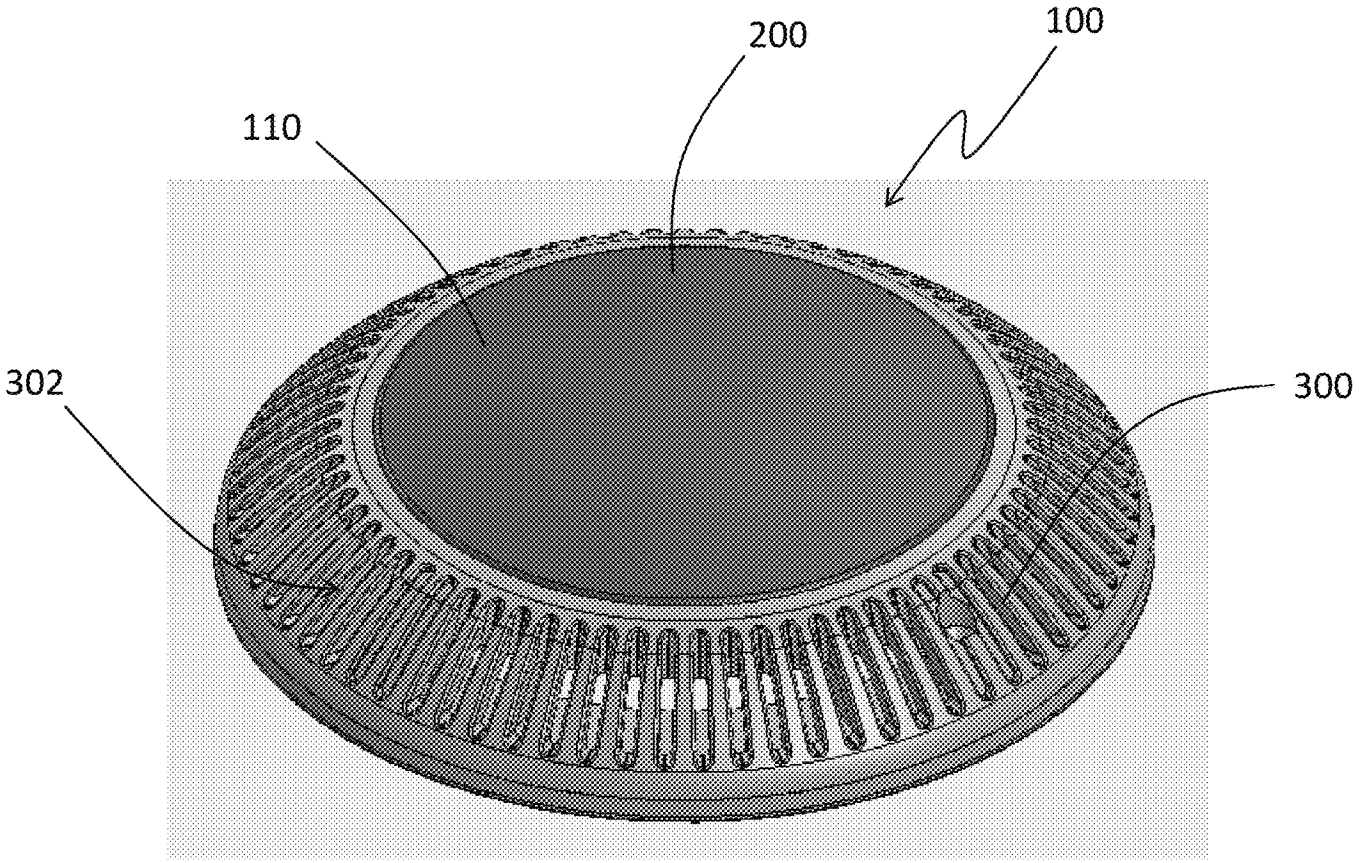
FIG. 1 is a top perspective view of an embodiment of a drain cover assembly.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extend beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIG. 1 depicts a non-limiting, illustrative embodiment of a vinyl pool drain cover assembly 100 of the present disclosure. The drain cover assembly 100 can be made up of a collection of components. Some or all of the components may be pre-assembled with one another, as discussed in more detail below. The drain cover assembly 100 can fit over a drain (not shown) for a water feature with a vinyl liner (e.g., vinyl pool, spa). In the illustrated embodiment, the drain cover assembly 100 has a substantially circular shape. In some embodiments, the drain cover assembly 100 has a shape other than circular (e.g., rectangular), as described in more detail below. The drain cover assembly 100 can have a top surface 110 that faces away from the drain. At least a portion of the top surface 110 of the drain cover assembly 100 can display at least a portion of an insert 200 that matches the appearance of the surrounding liner. In some embodiments, the insert 200 is a portion of the vinyl that is being used to line the pool. For example, an insert 200 can be made during installation of the vinyl pool liner by cutting to size a small piece of liner to secure in the drain cover assembly 100, as described in more detail below. The insert 200 can be made of a flexible, stretchable, or pliable material. The insert 200 can be made of a material that can stretch under moderate stress and recover its initial unstretched form when the stress is removed. In some arrangements, the insert 200 is made from a sheet of polymeric material. In some embodiments, the insert 200 is made of polymer having a thickness within a range of about 0.010 inches to 0.040 inches. In certain arrangements, the insert 200 can be made of vinyl having a thickness of 0.020 inches, 0.030 inches, or values therebetween.

In other embodiments, the insert 200 can be selected to blend in visually with an existing liner (not shown) that lines the water feature in which the drain cover assembly 100 is installed. For example, the vinyl pool drain cover assembly 100 can be used to retrofit an existing vinyl pool liner. The insert 200 can be exchangeable. For example, a first insert 200 can be removed from the drain cover assembly and exchanged for a second insert 200 that has a different appearance. A retainer ring 300 can circumferentially surround the insert 200 and include a plurality of openings 302 through which water can pass to reach the drain. As discussed below, the drain cover assembly 100 can provide a structural support system for an insert 200 made of a soft, pliable material (e.g., vinyl). In some variants, the drain cover assembly 100 allows the drain cover assembly 100 to blend in visually with a vinyl liner.

Figure 2:
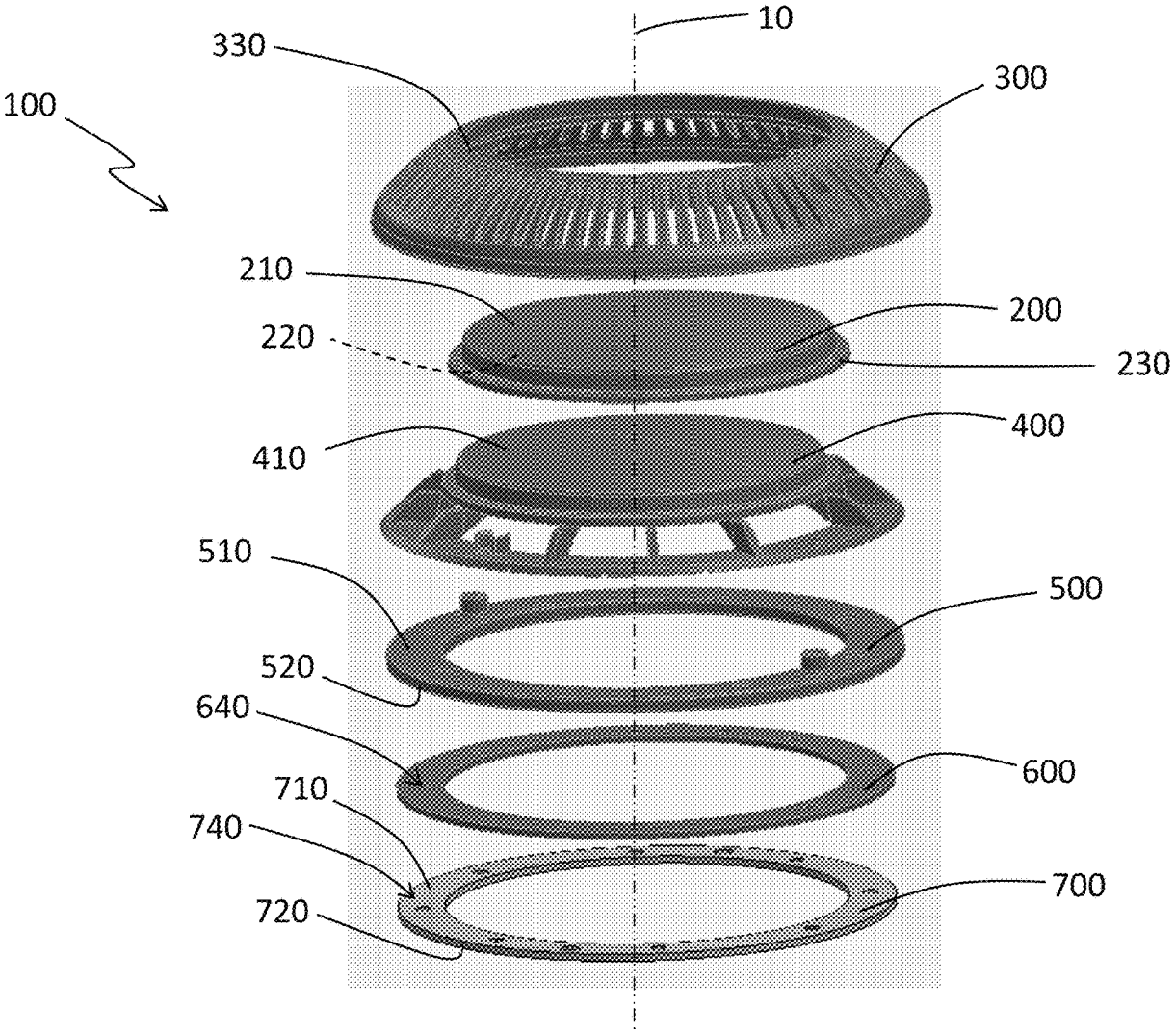
FIG. 2 is an exploded view of the embodiment of FIG. 1.

FIG. 2 is an exploded view of the illustrative embodiment of FIG. 1. The drain cover assembly 100 can include a retainer ring 300, an insert 200, a support plate 400, a floor ring 500, a top seal 600, and a bottom seal 700. In the illustrated embodiment, the floor ring 500, the top seal 600, and the bottom seal 700 have a generally circular shape and surround a longitudinal axis 10, as shown in FIG. 2. The floor ring 500, the top seal 600, and the bottom seal 700 can be positioned to circumferentially surround the drain (not shown). In some embodiments, the floor ring 500, the top seal 600, and the bottom seal 700 can have a shape other than circular (e.g., rectangular). As shown in FIG. 2, the bottom seal 700 can have a top surface 710 that faces the top seal 600. The bottom seal 700 can have a bottom surface 720 that faces away from the top surface 710. In some arrangements, the bottom surface 720 can be in contact with the inner surface of the water feature (e.g., pool, spa). In some variants, the bottom surface 720 can be in contact with the liner of the water feature. In some arrangements, the liner of the water feature is secured between the top seal 600 and the bottom seal 700, as described in more detail below.

With continued reference to FIG. 2, the top seal 600 and the bottom seal 700 can have a plurality of through holes 640, 740. The through holes 640, 740 can be adapted to align with one another when the top seal 600 is positioned on top of the bottom seal 700. The through holes 640, 740 can be adapted to align with fasteners (e.g., threaded holes, threaded posts) on a sump ring of the pool drain (not shown). The pool liner (not shown) can be secured between the top and bottom seals 600, 700 by positioning the bottom seal 700 over the fasteners of the pool drain, positioning the liner over the bottom seal 700, placing the top seal 600 over the liner with the through holes 640 of the top seal 600 aligned with the through holes 740 of the bottom seal 700, and then securing the top seal 600 to the bottom seal 700, such as, for example, by placing the floor ring 500 over the top seal 500 and securing the floor ring 500 to the sump ring of the drain. The liner can have a through hole in the portion of the liner that is circumferentially surrounded by the top and bottom seals 600, 700, thereby providing fluid communication to the drain.

The floor ring 500 can be disposed between the top seal 600 and the support plate 400. The floor ring 500 can have a through hole or other attachment feature that is adapted to allow the floor ring 500 to be attached to the support plate 400, and/or to the retainer ring 300, and/or to the top seal 600, and/or to the bottom seal 700, and/or to the sump or mud ring of a drain (not shown), as described in more detail below.

The insert 200 can be pinched, pinned, glued, or otherwise secured between a surrounding retaining member (e.g., the retainer ring 300) and a surrounded support member (e.g., the support plate 400). In some arrangements one or more intermediate structures can be interposed between the insert 200 and the surrounding retaining member and/or between the insert 200 and the surrounded support member. In the illustrated embodiment, the insert 200 has a bottom surface 220 that rests on a top surface 410 of the support plate 400. The insert 200 in FIG. 2 is shown in the shape the insert 200 takes after the vinyl pool drain cover assembly 100 has been assembled. However as discussed below, the insert 200 can have a floppy, fabric-like behavior, so that the insert 200 would not have the rigid, lid-like appearance shown in FIG. 2 when the insert 200 is disassembled from the drain cover assembly 100.

The periphery of the insert 200 can include a flange 230. The flange 230 can be sized to extend radially beyond an inner lip 330 of the retainer ring 300. The retainer ring 300 can secure the flange 230 of the insert 200 to the support plate 400, as discussed in more detail below. In the illustrated embodiment, the inner lip 330 radially overlaps with the flange 230 of the insert 200, thereby allowing the retainer ring 300 to secure the insert 200 between the retainer ring 300 and the support plate 400.

Figure 3:
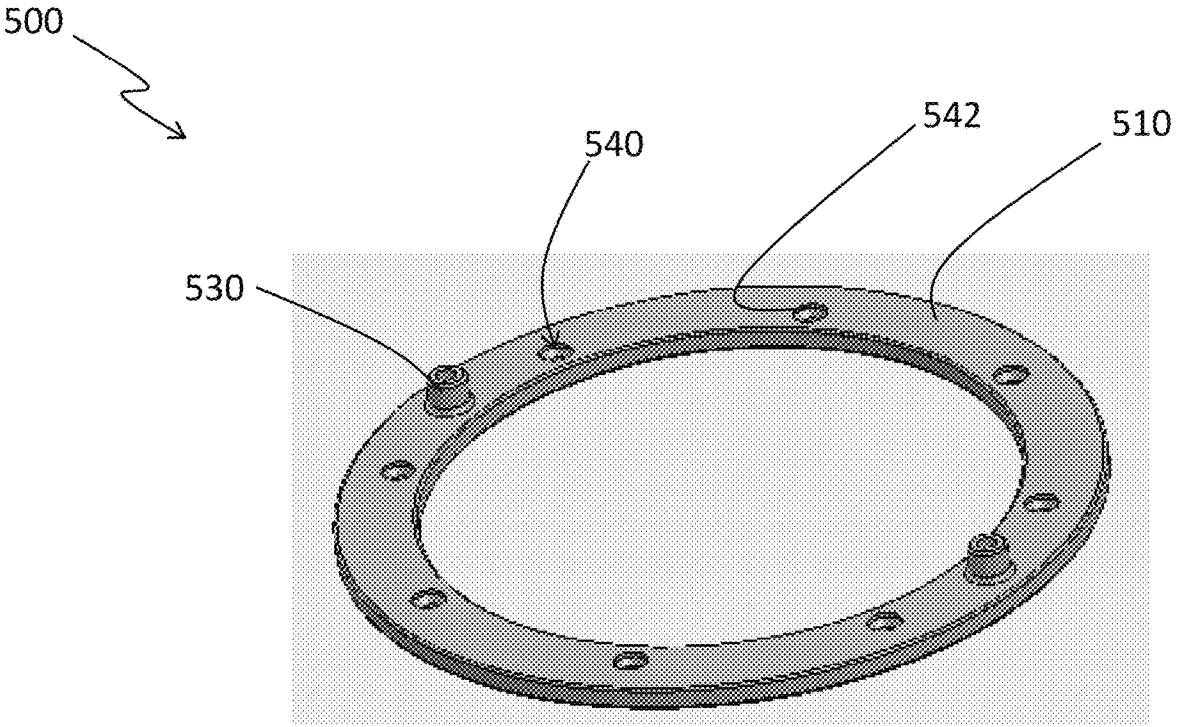
FIG. 3 is a partial top view of the floor ring of the embodiment of FIG. 2.

FIG. 3 shows a top view of the non-limiting, illustrative embodiment of the floor ring 500 of FIG. 2. The floor ring 500 can have a top surface 510 that faces away from the drain (not shown) when the drain cover assembly 100 is attached to the drain. The floor ring 500 can include one or more posts 530 that extend from the top surface 510 of the floor ring 500. In the illustrated embodiment, the floor ring 500 has two posts 530 that are spaced 180° apart circumferentially. However, the posts 530 can be arranged in other configurations. For example, the floor ring 500 can include an even or odd number of posts 530 that can be evenly or unevenly distributed circumferentially on the floor ring 500.

The floor ring 500 can include one or more through holes 540. The through holes 540 can be adapted to receive a fastener (not shown) that secures the floor ring 500 to an inner surface of the water feature (e.g., the sump or mud ring of the drain). In the illustrated embodiment, the through holes 540 are spaced apart generally equally from adjacent through holes 540 and include countersinks 542. However, other configurations of the through holes 540 are possible. For example, the through holes 540 can be unevenly distributed circumferentially or may not include countersinks 542.

Figure 4A:
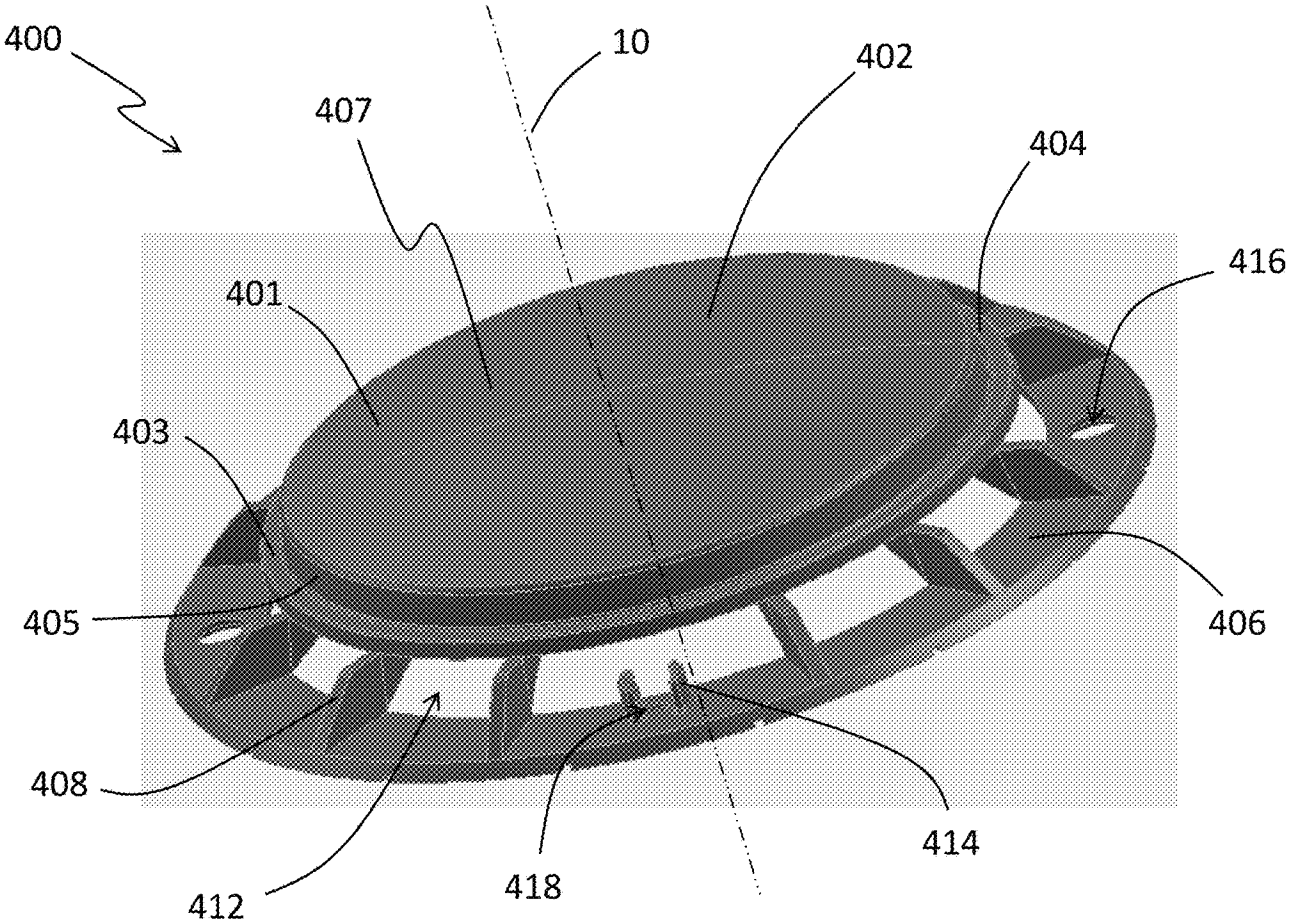
FIG. 4A is a partial top view of the support plate of the embodiment of FIG. 2.

FIG. 4A shows a partial top view of the non-limiting, illustrative embodiment of the support plate 400 of FIG. 2. As mentioned, the support plate 400 can have a substantially circular shape and can circumferentially surround a longitudinal axis 10. The support plate 400 can have a cap 402 which supports the insert 200. The cap 402 can have a radially-inward portion 401 that extends longitudinally away from a radially-outward portion 403 to form a ledge 404. A top face 407 of the cap 402 faces away from the floor ring 500 (shown in Figure). A sidewall 405 can connect the ledge 404 to the radially-inward portion 401. In the illustrated embodiment, the sidewall 405 extends substantially parallel to the longitudinal axis 10, the ledge 404 extends substantially perpendicular to the sidewall 405, and the top face 407 of the cap 402 is slightly convex. However, the cap 402 can have different configurations. For example, the sidewall 405 can be angled relative to the longitudinal axis, the ledge 404 can form an acute or obtuse angle with the sidewall 405, and the top surface 407 can be slightly concave or planar.

The cap 402 can be covered by the insert 200 when the drain cover assembly 100 is assembled. The insert 200 can be cut so that the flange 230 of the insert 200 extends onto the ledge 404 when the vinyl pool drain cover assembly 100 is assembled, thereby securing the flange 230 of the insert 200 between the ledge 404 of the support plate 400 and the lip 330 of the retainer ring 300. In the illustrated embodiment, the cap 402 is substantially impervious. However, in some arrangements the cap 402 can contain one or more through holes that communicate from the top surface 407 of the cap 402 to the opposing surface of the cap 402. In certain arrangements, at least a portion of the cap 402 can include a mesh or a screen.

As shown in FIG. 4A, the support plate 400 can include a base ring 406. The base ring 406 can be connected to the cap 402 by a plurality of struts 408. The struts 408 can provide support to the cap 402 of the support plate 400. The struts 408 can be arranged to provide openings 412 through which water can flow into the central portion of the drain cover assembly 100 to reach the drain (not shown) that is covered by the drain cover assembly 100. In the illustrated embodiment, the cap 402 is integral or pre-assembled with the struts 408. In some embodiments, the cap 402 can be separate from the struts 408. In some arrangements, the cap 402 rests on the struts 408 when the drain cover assembly 100 is assembled but the cap 402 is not otherwise fixed to the struts 408.

With continued reference to FIG. 4A, the base ring 406 can include a clip 414 and a hole 416 for securing the support plate 400 to the retainer ring 300 and the floor ring 500, as discussed below. In some variants, the clip 414 can surround an aperture 418 that allows a fastener (e.g., screw) to be coupled to the base ring 406 of the support plate 400. In some arrangements, the base ring 406 does not include a clip 414.

Figure 4B:
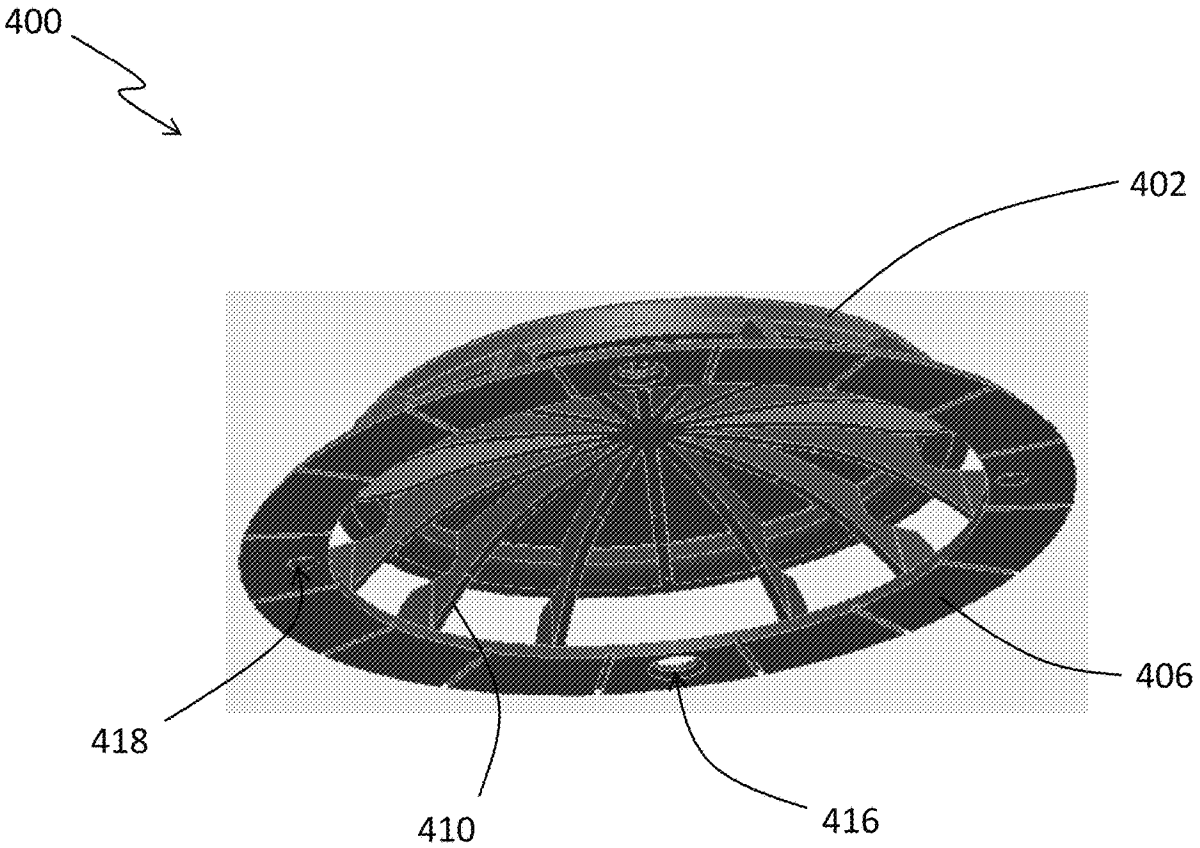
FIG. 4B is a partial bottom view of the support plate of the embodiment of FIG. 4A.

FIG. 4B shows a partial bottom view of the support plate 400 shown in FIG. 4A. As shown in FIG. 4B, the struts 408 can extend across at least a portion of the under surface of the cap 402. The struts 408 can be configured to support the cap 402 and prevent the cap 402 from deforming toward the drain (not shown). The struts 408 can give the cap 402 rigidity to resist the suction forces from the drain over which the drain cover assembly 100 is installed. In the illustrated embodiment, the struts 408 have an arch-like structure. However, the struts 408 can have other configurations such as a cage or a plurality of columns.

Figure 5:
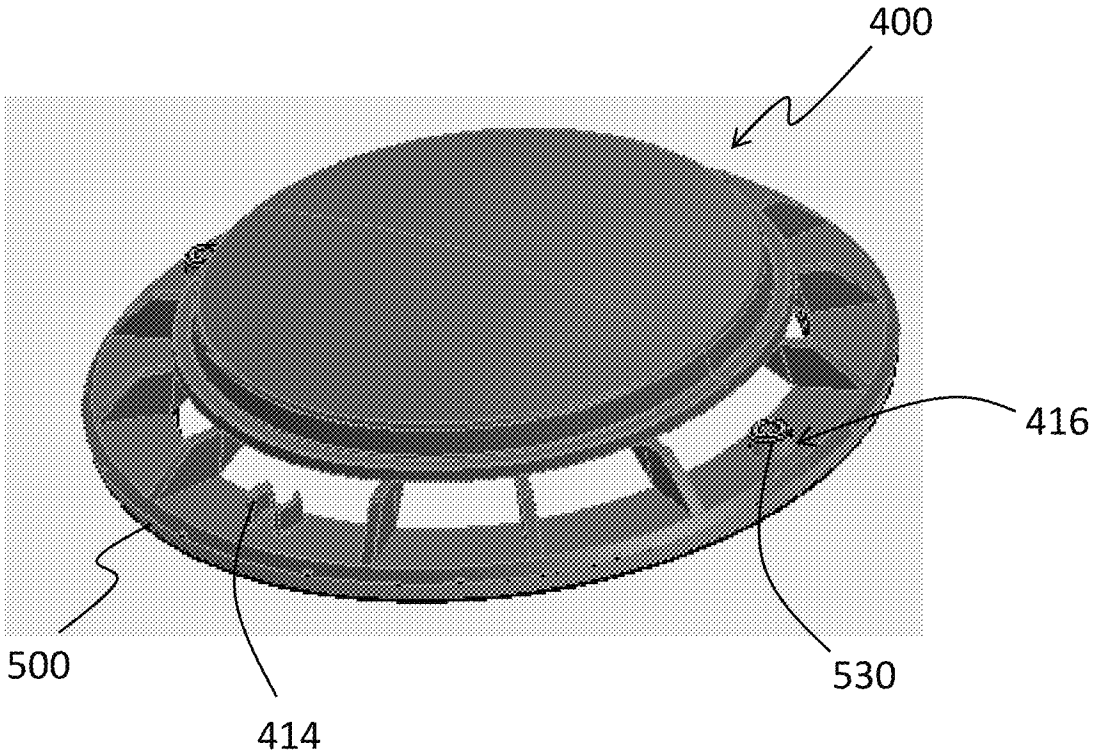
FIG. 5 is a partial top view of the support plate and the floor ring of a drain cover assembly of the embodiment of FIG. 2.

FIG. 5 shows the support plate 400 seated onto the floor ring 500. In the illustrated embodiment, the base ring 406 radially overlaps the floor ring 500. The posts 530 of the floor ring 500 can extend through the holes 416 of the base ring 406 of the support plate 400, as shown in FIG. 5.

Figure 6:
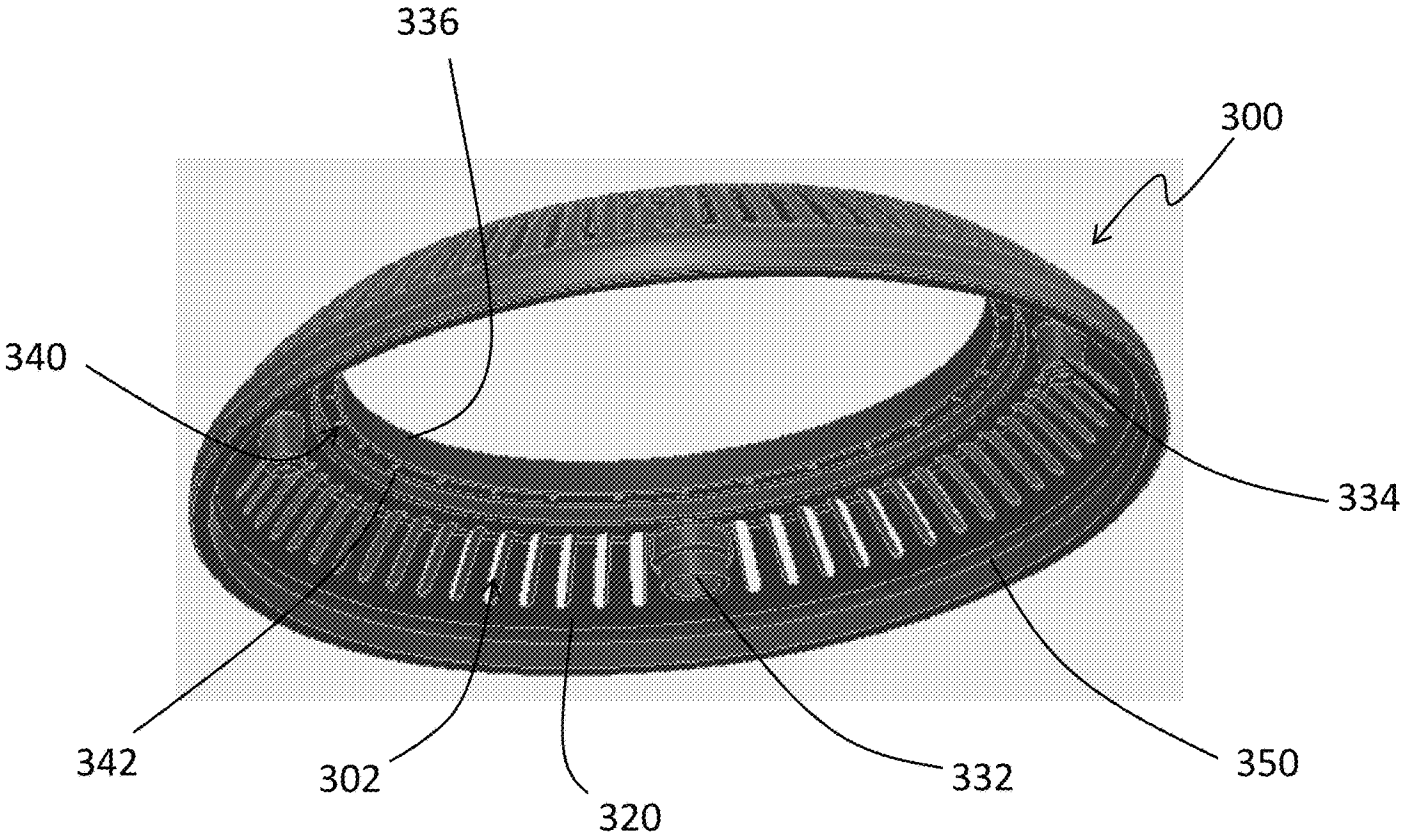
FIG. 6 is a partial bottom view of the retainer ring of FIG. 2.

FIG. 6 is a partial bottom view of the retainer ring 300 of the embodiment shown in FIG. 2. The retainer ring 300 can have a bottom surface 320 that faces the drain (not shown) when the drain cover assembly 100 is assembled onto the drain. The bottom surface 320 of the retainer ring 300 can include features that help secure the components of the drain cover assembly 100 to one another. One or more columns 332 can extend from the bottom surface 320 of the retainer ring 300. One or more posts 334 can extend from the bottom surface 320 of the retainer ring 300. In the illustrated embodiment, the retainer ring 300 has two columns 332 and two posts 334, with the columns 332 being spaced 90° apart circumferentially from an adjacent post 334. However, different configurations and numbers of columns 332 and posts 334 are possible. The columns 332 can be adapted to secure the retainer ring 300 to the floor ring 500, as discussed in more detail below. The posts 334 can be adapted to secure the retainer ring 300 to the support plate 400, as discussed in more detail below.

The retainer ring 300 can include an inner rim 336 that extends from the bottom surface 320 toward the drain (not shown) when the drain cover assembly 100 is assembled onto the drain. The inner rim 336 can be radially inward of the lip 330 (shown in FIG. 2), thereby defining an annular groove 340. In some variants, the inner rim 336 can help pull the insert 200 taut over the cap portion 402 of the support plate 400 as the retainer ring 300 is tightened onto the support plate 400 and/or onto the floor ring 500. As described in more detail below, the insert 200 can be interposed between the inner rim 336 of the retainer ring 300 and the sidewall 405 of the cap 402 when the drain cover assembly 100 is assembled. The annular groove 340 may include protrusions 344 that pin the flange 230 of the insert 200 to the retainer ring 300, thereby holding the insert 200 in place as the vinyl pool drain cover assembly 100 is assembled. In some variants, the top groove 340 can include an adhesive or clip to hold the flange 230 in place while the vinyl pool drain cover assembly 100 is assembled. In certain variants, the retainer ring 300 does not include an inner rim 336.

The outer periphery of the bottom surface 320 may be flared to create a lower skirt 350, as shown in FIG. 6. The lower skirt 350 can be sized to fit over at least a portion of the base ring 406 of the support plate 400. In some variants, the lower skirt 350 can be sized to fit over at least a portion of the floor ring 500.

Figure 7:
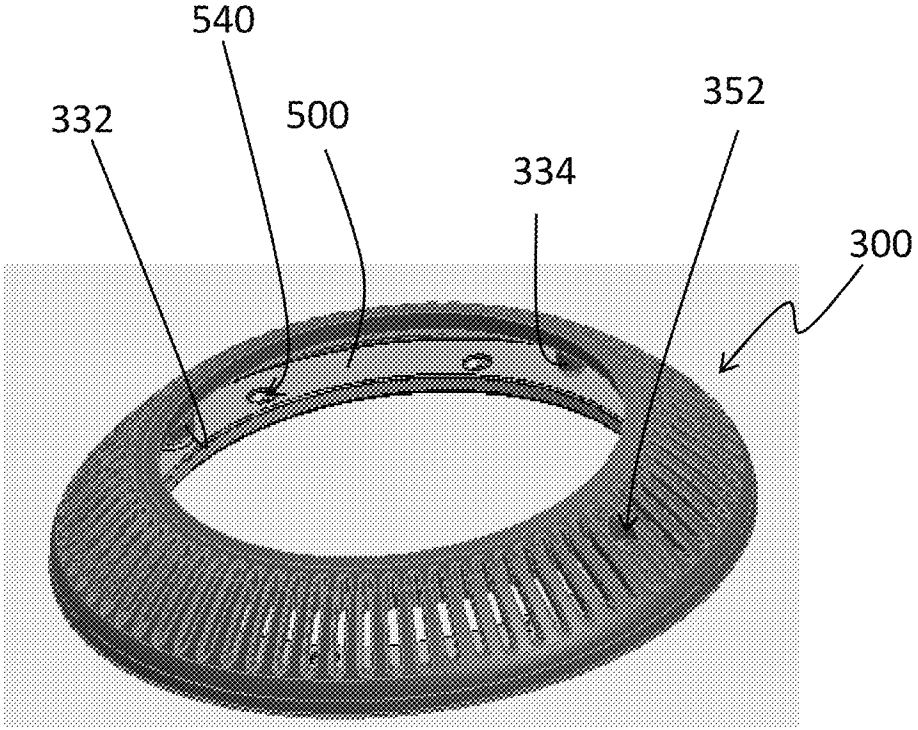
FIG. 7 is a partial top view of the retainer ring and the floor ring of a drain cover assembly of the embodiment of FIG. 2.

Referring to FIG. 7, the columns 332 of the retainer ring 300 can align with the posts 530 (shown in FIG. 3) of the floor ring 500. For the sake of clarity, the support plate 400 is not shown in in FIG. 7. However, the vinyl pool drain cover assembly 100 would have the support plate 400 interposed between the retainer ring 300 and the floor ring 500, with the support plate 400 being positioned on the floor ring 500 as shown in FIG. 5. In some variants, the columns 332 of the retainer ring 300 can receive the posts 530 of the floor ring 500. The posts 530 can extend through holes 416 of the support plate 400, thereby securing the support plate 400 between the retainer ring 300 and the floor ring 500. In certain embodiments, the column 332 and the post 530 are coupled together by a snap fit. For example, the column 332 can snap over the post 530. The column 332 and the post 530 can be secured together by a fastener (e.g., screw). The retainer ring 300 can include an access 352 that allows a fastener to extend through the column 332 of the retainer ring 300 and into the post 530 of the floor ring 500. The posts 530 can include an internal thread that is adapted to mate with the external thread of a fastener that extends through the column 332.

The post 334 of the retainer ring 300 can be positioned to align with the clip 414 (shown in FIG. 5) of the support plate 400. In some embodiments, the post 334 fits into the clip 414 and is secured by a snap fit. In certain variants, the post 334 can be secured to the floor ring 500 by a fastener (e.g., screw) that is passed through the bottom surface of the support plate 400 and extends up into the post 334, as described in more detail below.

Figure 8A:
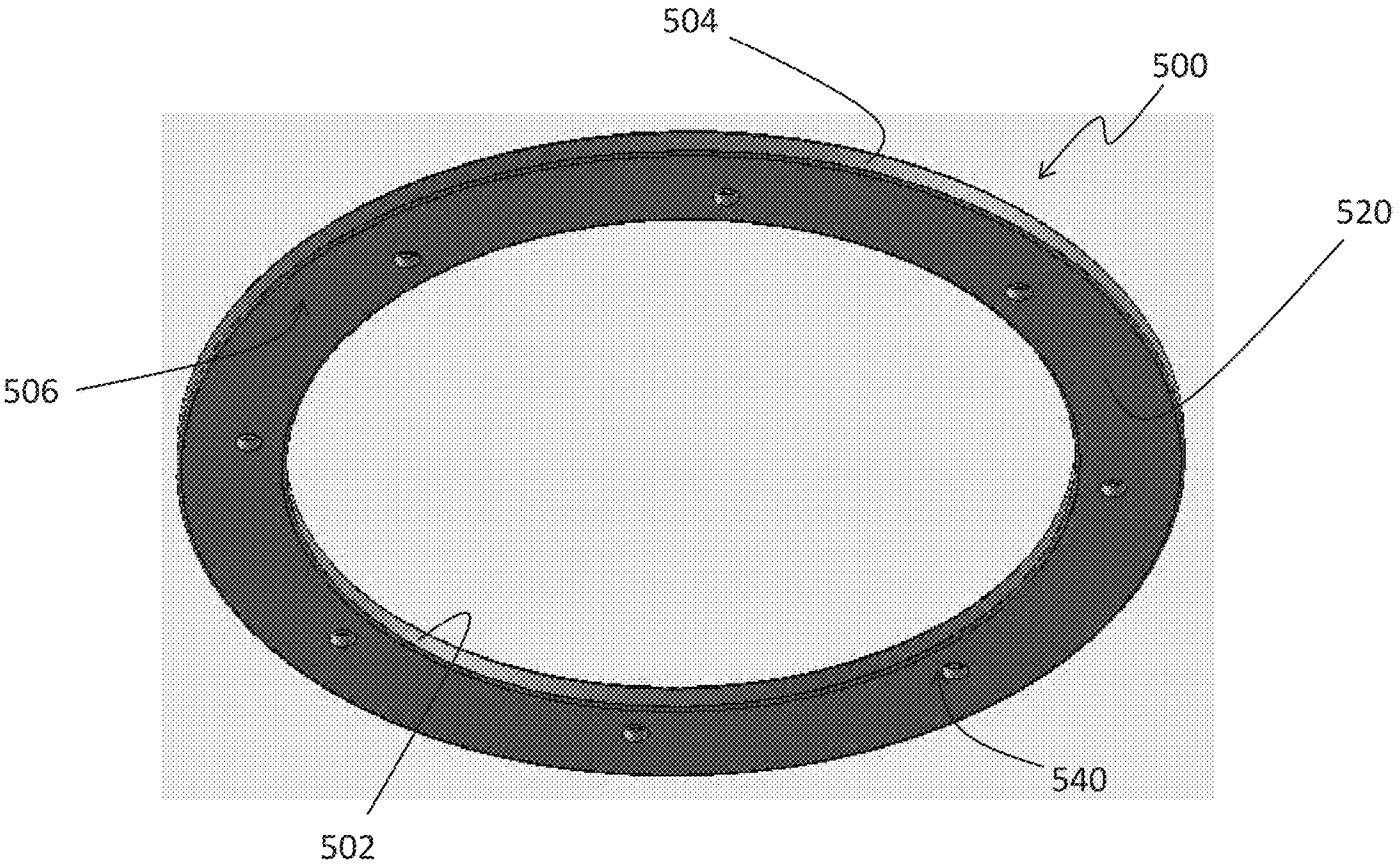
FIG. 8A is a partial bottom view of the floor ring of FIG. 2.
Figure 8B:
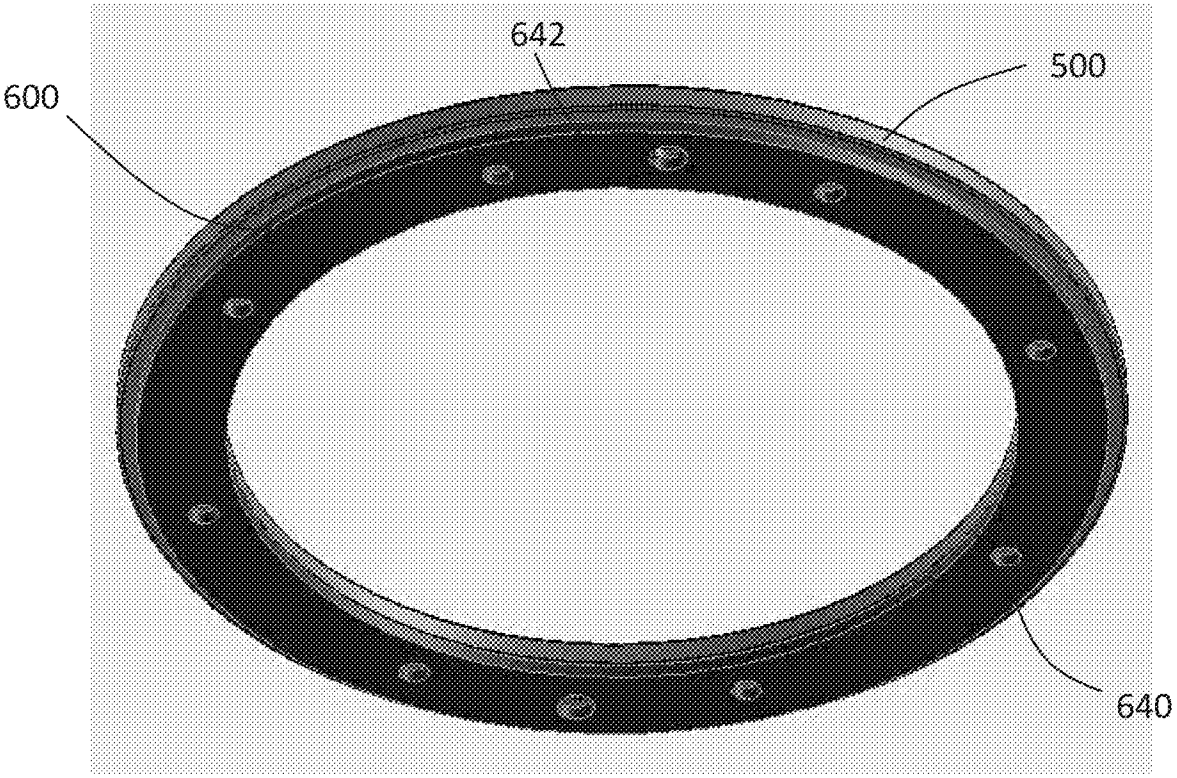
FIG. 8B is a partial bottom view of the floor ring and the top seal of FIG. 2.

FIG. 8A shows a partial bottom view of the floor ring 500 of FIG. 2. The floor ring 500 can have an inner rim 502 and an outer rim 504 that extend from the bottom surface 520 of the floor ring 500 toward the drain (not shown) when the drain cover assembly 100 is assembled onto the drain. In some variants, the floor ring 500 does not have an inner or outer rim 502, 504 but rather has a planar bottom surface 520. The inner and outer rims 502, 504 can define a recess 506 therebetween. The recess 506 can be sized to receive the top seal 600, as shown in FIG. 8B. Referring to FIG. 8B, the top seal 600 can have openings 640. The openings 640 of the top seal 600 can be configured to align with the openings 540 of the floor ring 500. The openings 640 of the top seal 600 can have countersinks 642, as described above for the openings 540 of the floor ring 500. The openings 640 can be configured to allow a fastener to be passed through the top seal 600 and extended into the floor ring 500, thereby allowing the top seal 600 to be secured to the floor ring 500. In some variants, the fastener can be passed through the floor ring 500 and extended into the top seal 600.

Figure 8C:
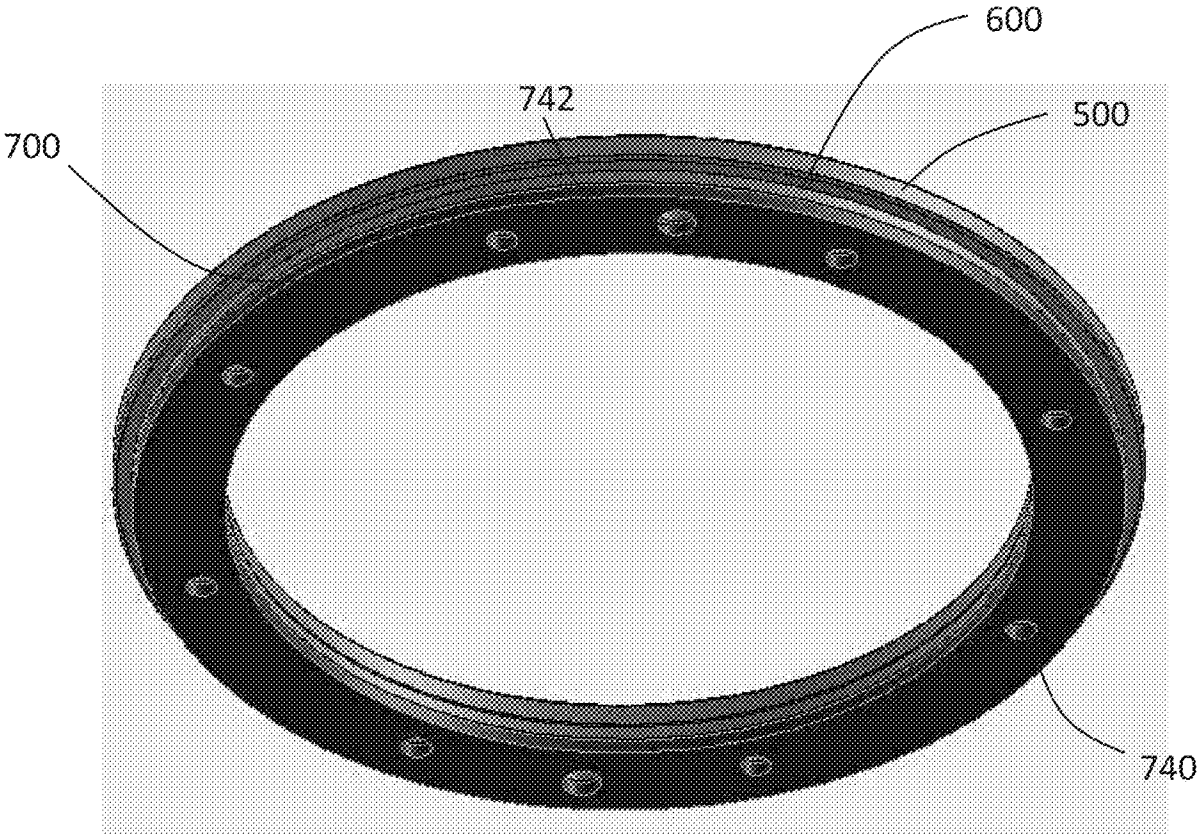
FIG. 8C is a partial bottom view of the floor ring, the top seal, and the bottom seal of FIG. 2.

FIG. 8C is a partial bottom view of the floor ring 500 with the top and bottom seals 600, 700 assembled to the floor ring 500. The top seal 600 can be disposed between the floor ring 500 and the bottom seal 700. The bottom seal can have openings 740 that can have countersinks 742 as described above for the floor ring 500. The openings 740 can be configured to align with the openings 640, 540 of the top seal 600 and/or the floor ring 500. The top and bottom seal 600, 700 can be made of silicone, rubber, or other suitable seal material.

Figure 9A:
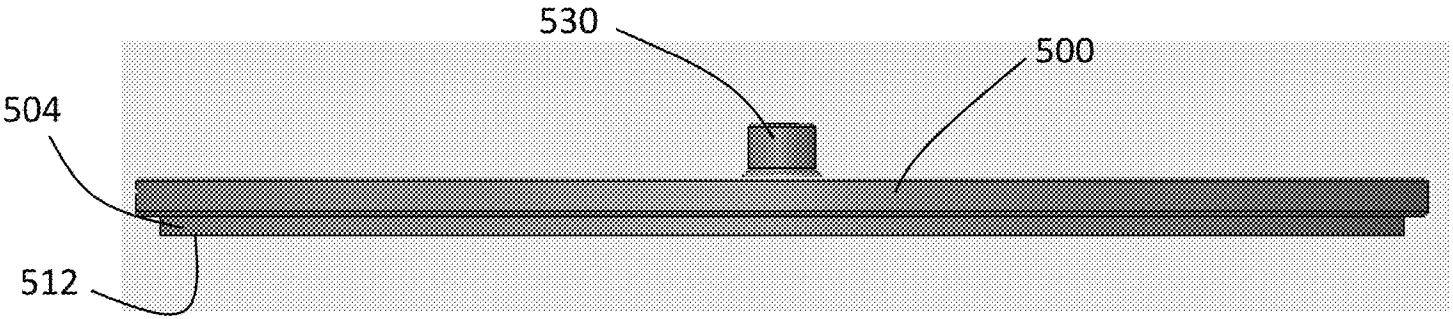
FIG. 9A is a side view of the floor ring and the top seal of FIG. 2.
Figure 9B:
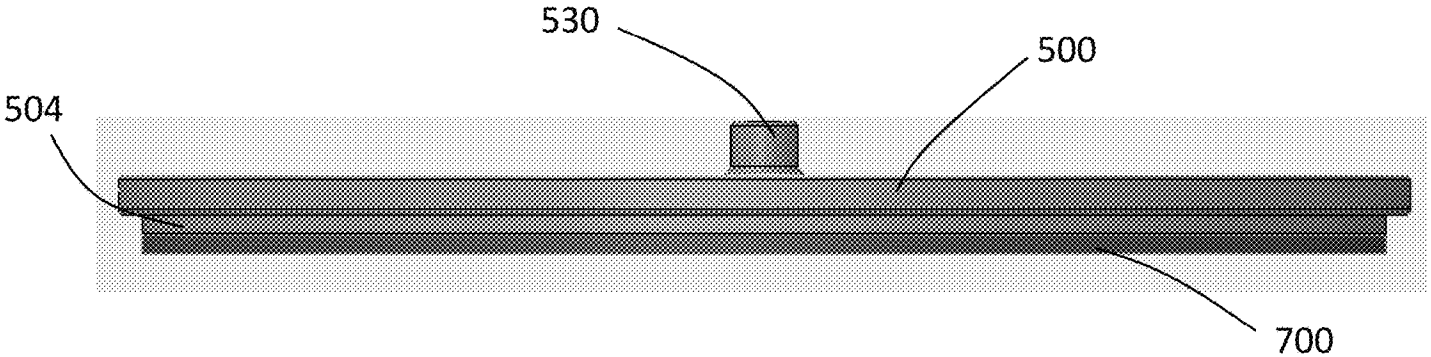
FIG. 9B is a side view of the floor ring, the top seal, and the bottom seal of FIG. 2.

FIG. 9A is a side view of the floor ring 500 with the top seal 600 assembled to the floor ring 500. In the illustrated embodiment, the top seal 600 is flush with the bottom surface of the outer rim 504 of the floor ring 500, thus the top seal 600 is not visible from the side. In some variants, the top seal 600 can be recessed or proud relative to the bottom surface of the outer rim 504 of the floor ring 500. FIG. 9B is a side view of the floor ring 500 with the top seal 600 and the bottom seal 700 assembled to the floor ring. In the illustrated embodiment, the bottom seal 700 fully extends beyond the bottom surface 512 of the outer rim 504 of the floor ring 500 because the top seal 600 is flush with the bottom surface 512 of the outer rim 504, as mentioned above. However, in some embodiments, at least a portion of the bottom seal 700 overlaps longitudinally with the outer rim 504 of the floor ring 500.

An illustrative embodiment of a method of assembling and installing the drain cover assembly 100 in a water feature will now be discussed. However, the method discussed is illustrative only and is to be taken as non-limiting. The order of the assembly steps can be varied and not all steps need be performed.

Referring to FIGS. 2 and 6, the insert 200 is cut to size so that the insert 200 has a sufficiently large outer dimension so that the flange 230 can extend radially beyond at least a portion of the sidewall 405 of the cap 402. The insert 200 is positioned within the central opening of the retainer ring 300, and the flange 230 portion of the insert 200 is positioned over the rim 336 of the retainer ring 300 and pushed into the annular groove 340. The flange 230 can be secured to the annular groove 340 by pins 342 or adhesive or other means present on the annular groove 340. The cap 402 of the support plate 400 is positioned within the central opening of the retainer ring 300. The clips 414 of the support plate 400 are aligned with the posts 334 of the retainer ring 300. The support plate 400 is secured to the retainer ring 300 by threading a fastener (e.g., screw) through the aperture 418 of the base ring 406 and into the threaded post 334 of the retainer ring 300. The insert 200 is pulled taut across the cap 402 as the sidewall 405 moves longitudinally past the bottom surface 320 of the retainer ring 300.

After the support plate 400 is attached to the retainer ring 300, the retainer ring 300 can then be secured to the sump ring of the drain. The bottom seal 700 can first be secured to the sump ring of the drain. The liner can be layered over the bottom seal 700. The top seal 600 can be positioned over the bottom seal 700 with the liner interposed between the top and bottom seals 600, 700. The floor ring 500 can be positioned over the top seal 600 and secured to the sump ring of the drain, thereby securing the liner between the top and bottom seals 600,700. The support plate 400 with the attached retainer ring 300 can be positioned over the floor ring 500 so that the posts 530 of the floor ring 500 pass through the holes 416 of the support plate 400, thereby aligning the columns 332 of the retainer ring 300 with the posts 530 of the floor ring 500. Fasteners can be threaded through the columns 332 of the retainer ring 300 are into the posts 530 of the floor ring 500, thereby securing the drain cover assembly 100 to the sump ring of the drain. When the drain cover assembly 100 is installed, the insert 200 is positioned over the drain of the water feature. The insert 200 is supported by the support cap 400 and blends in with the liner of the water feature, thereby providing a drain cover that is less disruptive to the aesthetic appeal of the water feature.

The present disclosure further illustrates a method of retrofitting existing vinyl drain covers. The method includes providing a drain cover assembly 100 having a vinyl insert 200 that matches the surrounding vinyl liner as described herein. The insert 200 is assembled into the drain cover assembly by securing the support plate 400 to the retaining ring, as described above. The assembled insert 200 is then attached to the sump ring of the drain by securing the floor ring 500 to the sump ring and then attaching the retainer ring 300 to the floor ring 500, as described above.

Figure 10:
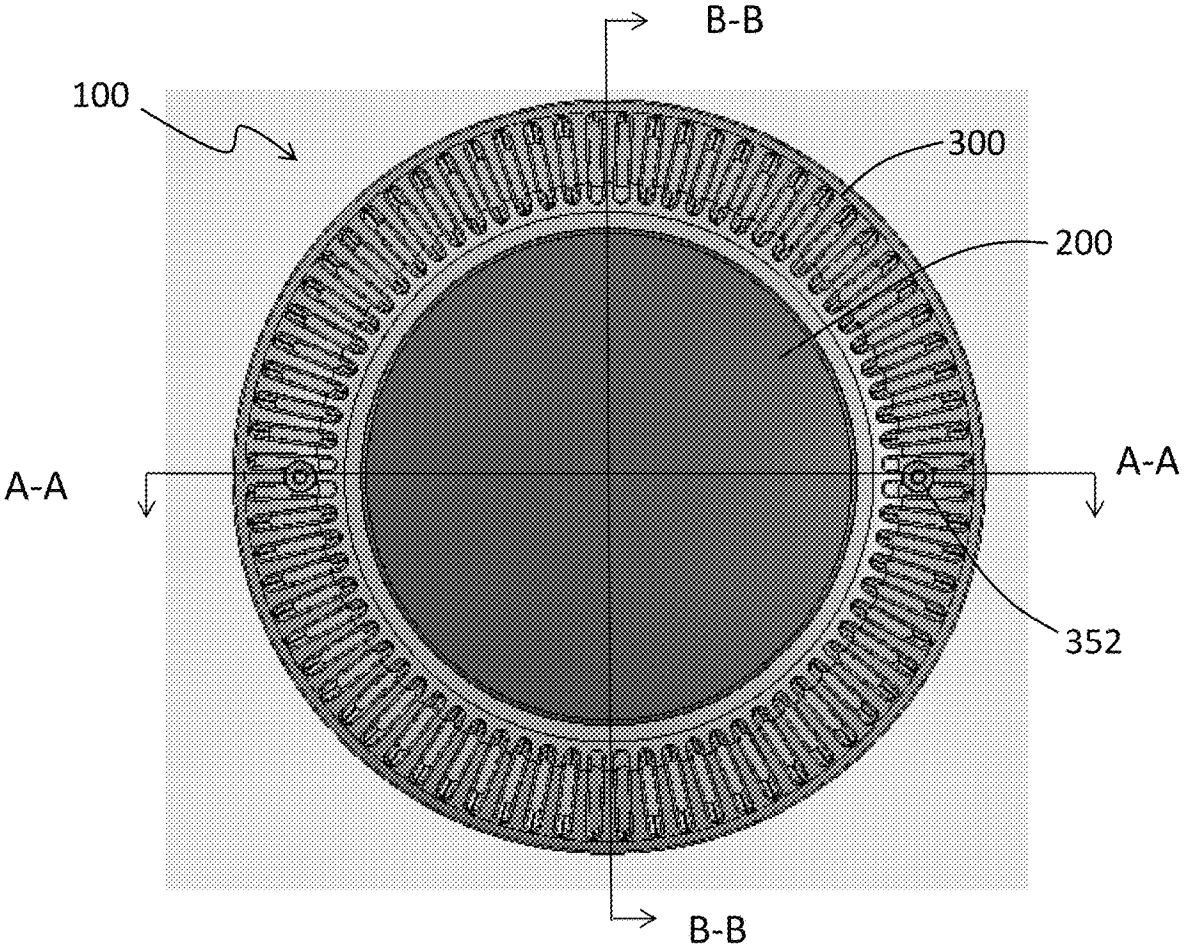
FIG. 10 is a top view of the drain cover assembly of FIG. 2, illustrating the planes of cross-section for FIGS. 10A and 10B.
Figure 10A:
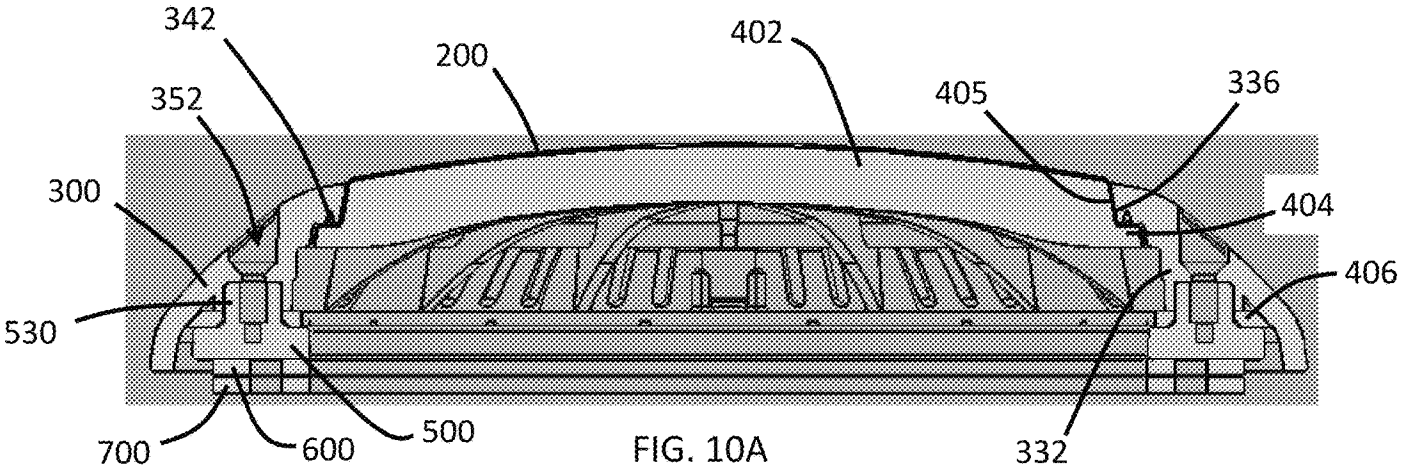
FIG. 10A is a side cross-sectional view of the drain cover assembly of FIG. 2 along the transverse plane A-A indicated in FIG. 10.
Figure 10B:
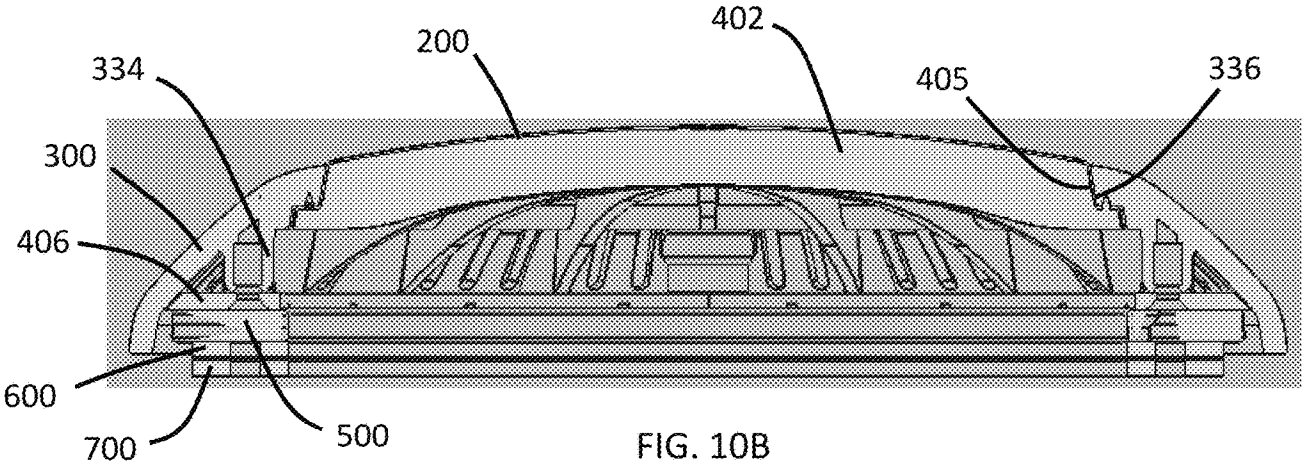
FIG. 10B is a side cross-sectional view of the drain cover assembly of FIG. 2 along the transverse plane B-B indicated in FIG. 10.

FIG. 10 is a top view of the drain cover assembly 100 shown in FIG. 1. FIG. 10A shows a cross-sectional view of the drain cover assembly 100 along a transverse plane that passes through the accesses 352 of the retainer ring 300 (as indicated in FIG. 10). FIG. 10B shows a cross-sectional view of the drain cover assembly 100 along a transverse plane that passes through the posts 334 of the retainer ring 300 (as indicated in FIG. 10). Referring to FIG. 10A, a fastener (not shown) can be passed through the access 352 of the retainer ring 300 and into the post 530 of the floor ring 500 to secure the floor ring 500 to the retainer ring 300 with the base ring 406 of the support plate 400 interposed therebetween. The insert 200 can be pinched or pinned or otherwise secured between the ledge 404 of the cap 402 and the retainer ring 300. Referring to FIG. 10B, a fastener (not shown) can be passed through a through hole of the base ring 406 of the support plate 400 and into the post 334 of the retainer ring 300 to secure the support plate 400 to the retainer ring 300. The insert 200 can be pulled taut when the sidewall 405 moves longitudinally past the inner rim 336 of the retainer ring 300 as the cap 402 is secured to the retainer ring 300.

Figure 11:
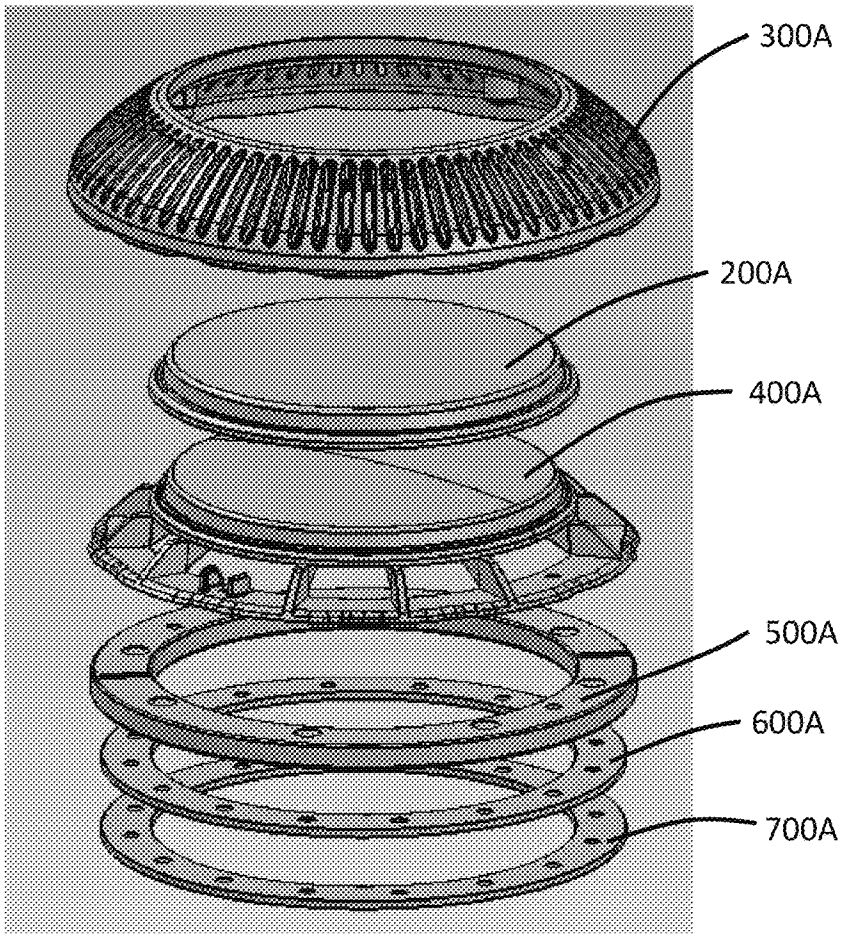
FIG. 11 is an exploded view of another embodiment of a drain cover assembly.

FIG. 11 depicts an exploded view of a drain assembly 100A that is similar to the drain assembly 100 except as described differently below. The features of the drain assembly 100A can be combined or included with the drain assembly 100 or any other embodiment discussed herein. The drain assembly 100A can have an insert 200A that is secured between a retainer ring 300A and a support plate 400A. The retainer ring 300A can be secured to a floor ring 500A that is secured to the sump ring of a drain (not shown).

Figure 12A:
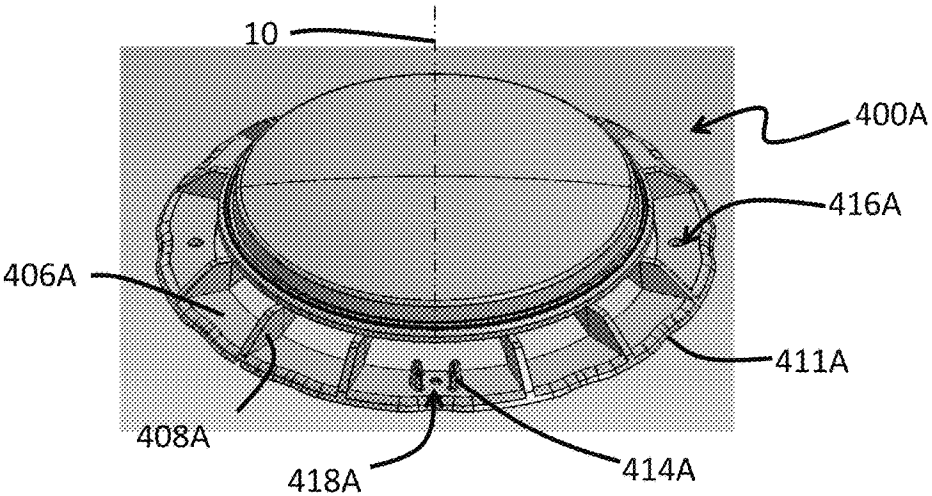
FIG. 12A is a partial top view of the support plate of the embodiment of FIG. 11.
Figure 12B:
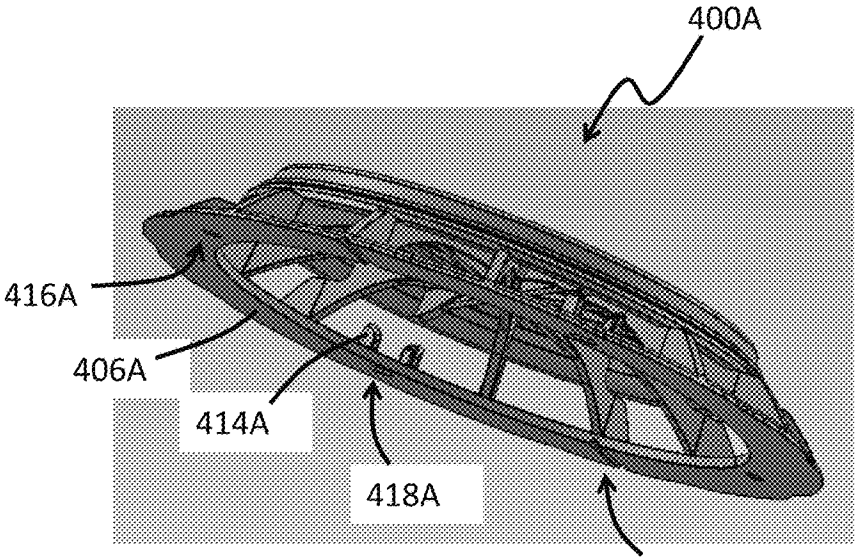
FIG. 12B is a partial bottom view of the support plate of the embodiment of FIG. 11.

FIG. 12A depicts a partial top view of a support plate 400A that is similar to the support plate 400 except as described differently below. The features of the support plate 400A can be combined or included with the support plate 400 or any other embodiment discussed herein. The support plate 400A can include a base ring 406A. The outer periphery of the base ring 406A can include one or more indentations 411A that extend radially inward toward the longitudinal axis 10. The indentations 411A can be circumferentially arranged so that the indentations 411A are disposed between the struts 408A of the support plate 400A, as shown in FIG. 12A. FIG. 12B shows a partial bottom view of the support plate 400A shown in FIG. 12A. The base ring 406A can have an alignment groove 413A disposed on the bottom surface of the base ring 406A, as shown in FIG. 12B. The alignment groove 413A can be adapted to mate with a corresponding alignment feature on the floor ring 500A, as described in more detail below.

Figure 13B:
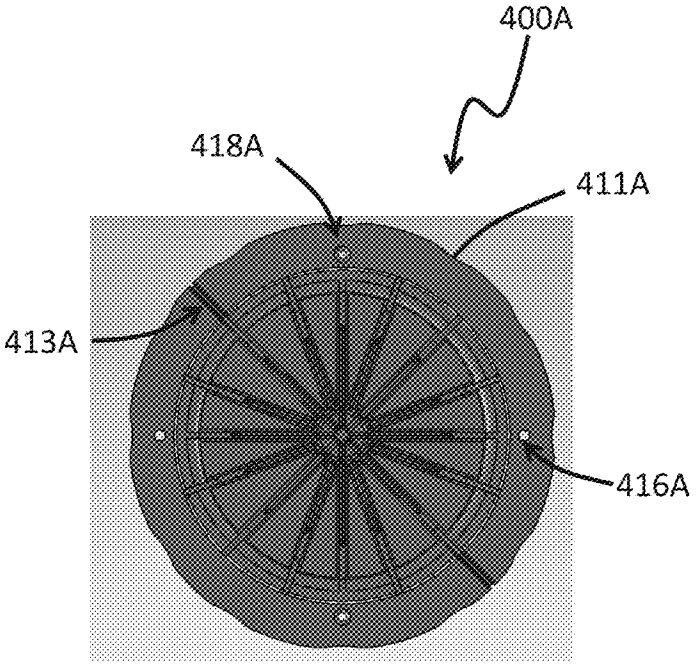
FIG. 13B is a bottom view of the support plate of the embodiment of FIG. 11.
Figure 13A:
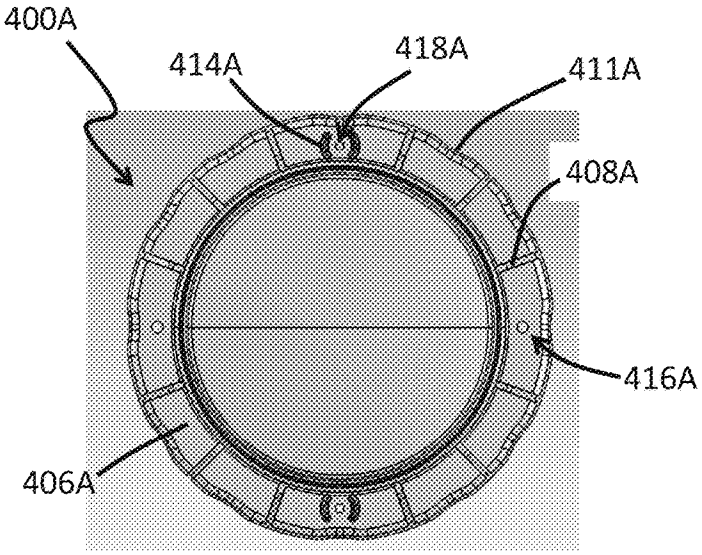
FIG. 13A is a top view of the support plate of the embodiment of FIG. 11.

FIG. 13A shows a top view of the support plate 400A shown in FIG. 12A, illustrating that the indentations 411A can be circumferentially offset from the struts 408A. FIG. 13B shows a bottom view of the support plate 400A shown in FIG. 13A, illustrating that the alignment groove 413A can be aligned with the struts 408A and can extend across a diameter of the support plate 400A. The alignment groove 413A can be configured differently. For example, the alignment groove 413A can be circumferentially offset from the struts 408A. Also, the alignment groove 413A need not extend across a diameter of the support plate 400A.

Figure 14A:
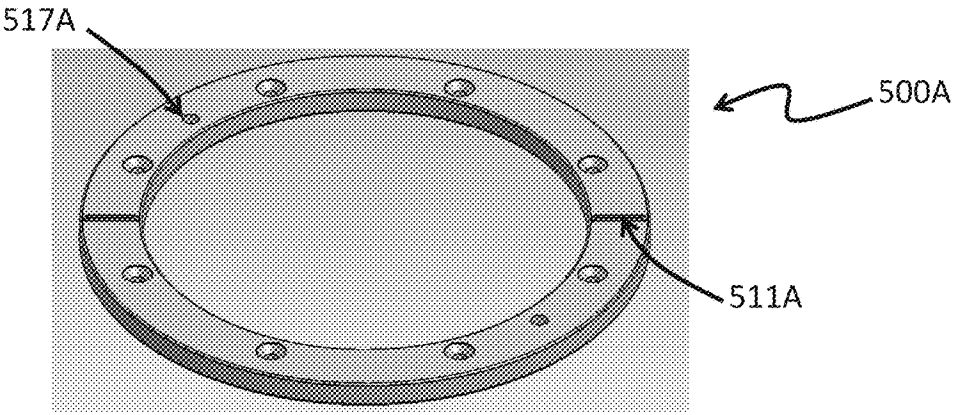
FIG. 14A is a partial top view of the floor ring of the embodiment of FIG. 11.
Figure 14B:
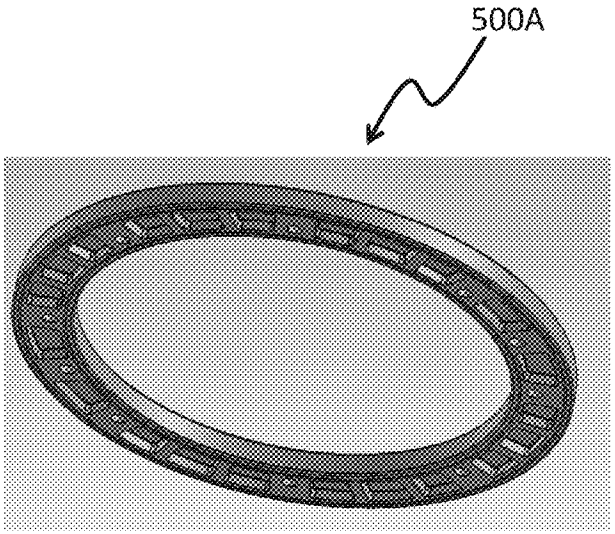
FIG. 14B is a partial bottom view of the floor ring of the embodiment of FIG. 11.

FIG. 14A depicts a partial top view of a floor plate 500A that is similar to the floor plate 500 except as described differently below. The features of the floor plate 500A can be combined or included with the floor plate 500 or any other embodiment discussed herein. The floor plate 500A can have an alignment ridge 511A that is configured to mate with the alignment groove 413 disposed on the bottom surface of the support plate 400A. The alignment ridge 511A can help align a ring hole 517A of the floor plate 500A with the column 332A of the retainer ring 300A so that the floor plate 500A can be secured to the retainer ring 300A, as described above. The alignment ridge 511A can be adapted so that the ring hole 517A of the floor ring 500A aligns with the hole 416A of the support plate 400A when the alignment ridge 511A is seated in the alignment groove 411A of the support plate 400A, thereby allowing a fastener to pass through the hole 416 of the support plate 400A to reach the ring hole 517A. FIG. 14B shows a partial bottom view of the floor ring 500A shown in FIG. 14A.

Figure 15B:
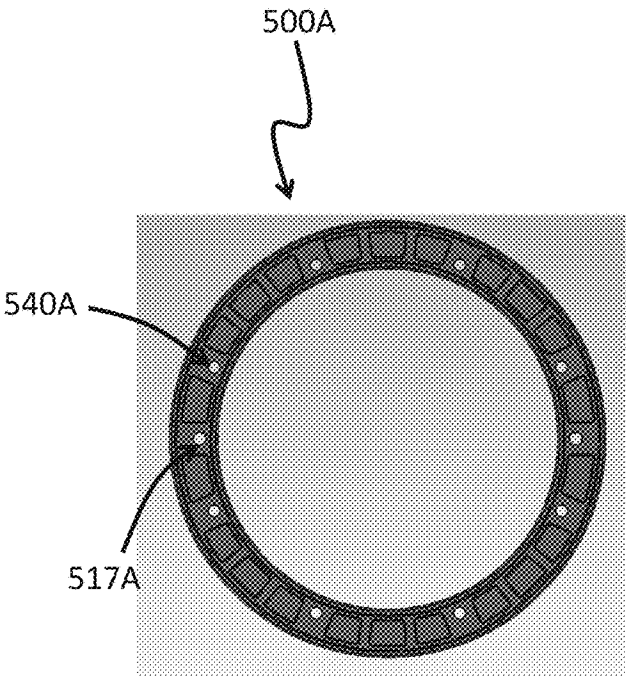
FIG. 15B is a bottom view of the floor ring of the embodiment of FIG. 11.
Figure 15A:
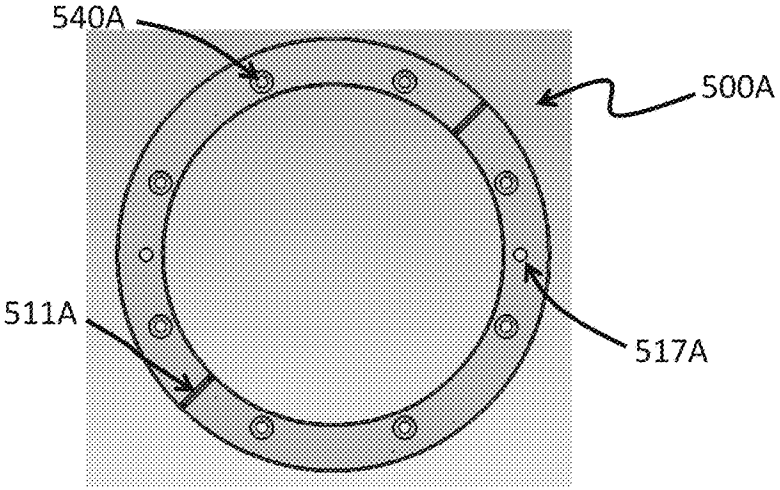
FIG. 15A is a top view of the floor ring of the embodiment of FIG. 11.

FIG. 15A shows a top view of the floor plate 500A shown in FIG. 14A, illustrating that the alignment ridge 511A and the ring holes 517A can be circumferentially interposed between the through holes 540A that align with the through holes of the top and bottom seals 600A, 700A. FIG. 15B shows a bottom view of the floor plate 500A shown in FIG. 15A.

Figure 16A:
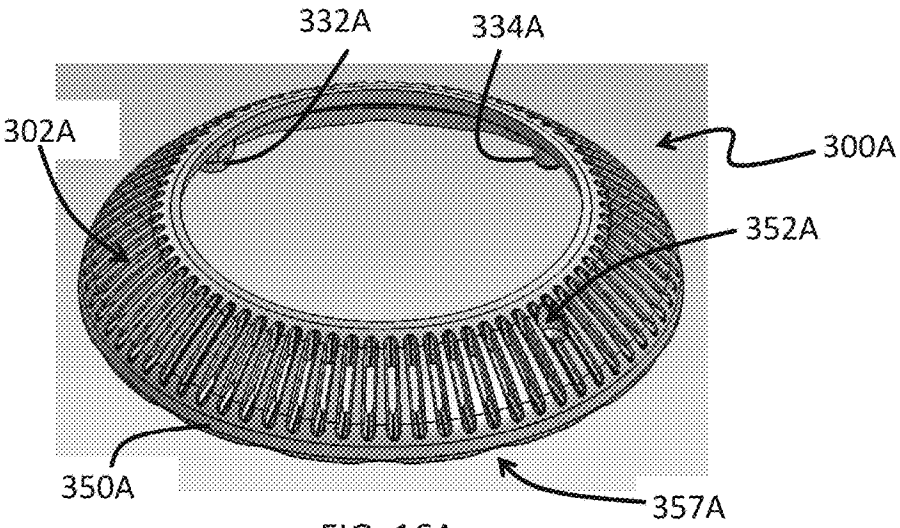
FIG. 16A is a partial top view of the retainer ring of the embodiment of FIG. 11.
Figure 16B:
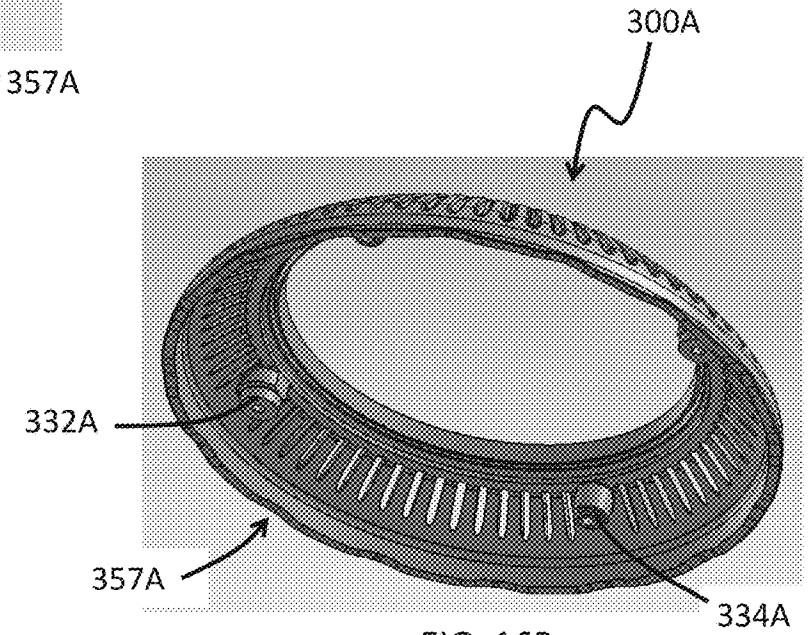
FIG. 16B is a partial bottom view of the retainer ring of the embodiment of FIG. 11.

FIG. 16A depicts a partial top view of a retainer ring 300A that is similar to the retainer ring 300 except as described differently below. The features of the retainer ring 300A can be combined or included with the retainer ring 300 or any other embodiment discussed herein. The retainer ring 300A can have a plurality of openings 302A that provide a fluid flow pathway through the retainer ring 300A. Water can access the drain by flowing through the openings 302A. The lower skirt 350A can have a plurality of scalloped arches 357A. The scalloped arches 357A can provide a secondary flow path for water to flow through the retainer ring 300A. The drain cover assembly 100A can be adapted so that the scalloped arches 357A substantially align with the indentations 411A (shown in FIG. 13A) when the support plate 400A is attached to the retainer ring 300A. The drain cover assembly 100A can be adapted so that water flowing under the scalloped arches 357 is not blocked by the base ring 406A of the support plate 400A. The scalloped arches 357A and the indentations 411A can enhance the safety of the drain cover assembly 100A. If the openings 302A become blocked by a swimmer's body, the scalloped arches 357A and the indentations 411A can provide a secondary flow path and thereby reduce the suction force applied through the blocked openings 302A. Water can flow under the scalloped arches 357A, over the indentations 411A, and between the struts 408A to reach the drain. The scalloped arches 357A can also reduce the accumulation of dirt and debris around the drain assembly 100A by providing a flow path for dirt and debris to pass by the lower skirt 350A of the retainer ring 300A and into the drain that is covered by the drain assembly 100A. FIG. 16B shows a partial bottom view of the retainer ring 300A shown in FIG. 16A.

Figure 17A:
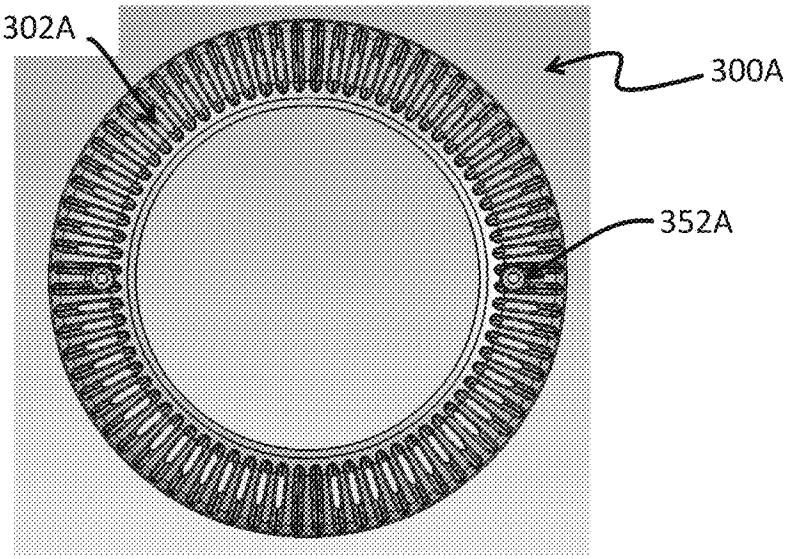
FIG. 17A is a top view of the retainer ring of the embodiment of FIG. 11.
Figure 17B:
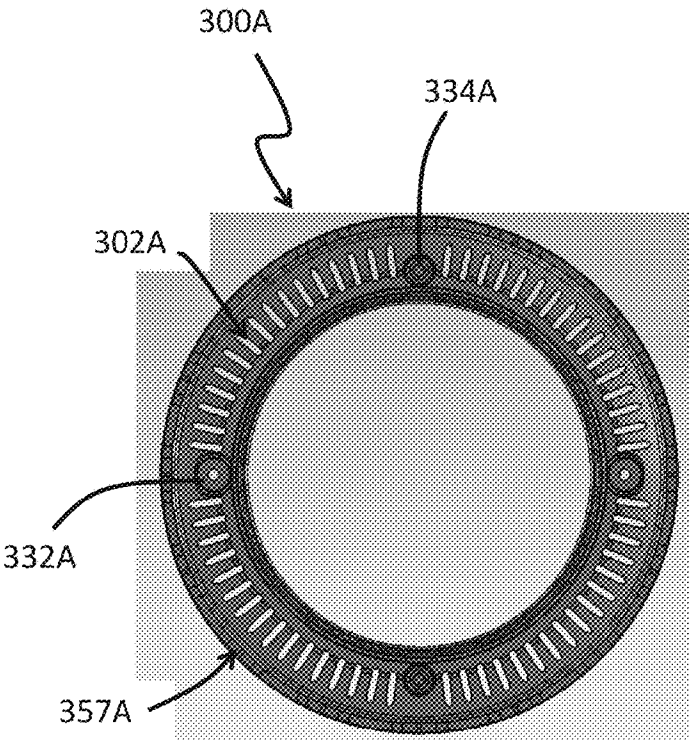
FIG. 17B is a bottom view of the retainer ring of the embodiment of FIG. 11.

FIG. 17A shows a top view of the retainer ring 300A shown in FIG. 16A. FIG. 17B shows a bottom view of the retainer ring 300A shown in FIG. 16B. As discussed above, the columns 332A can be used to secure the retainer ring 300A to the floor ring 500A. The posts 334A can be used to secure the retainer ring 300A to the support plate 400A.

Figure 18:
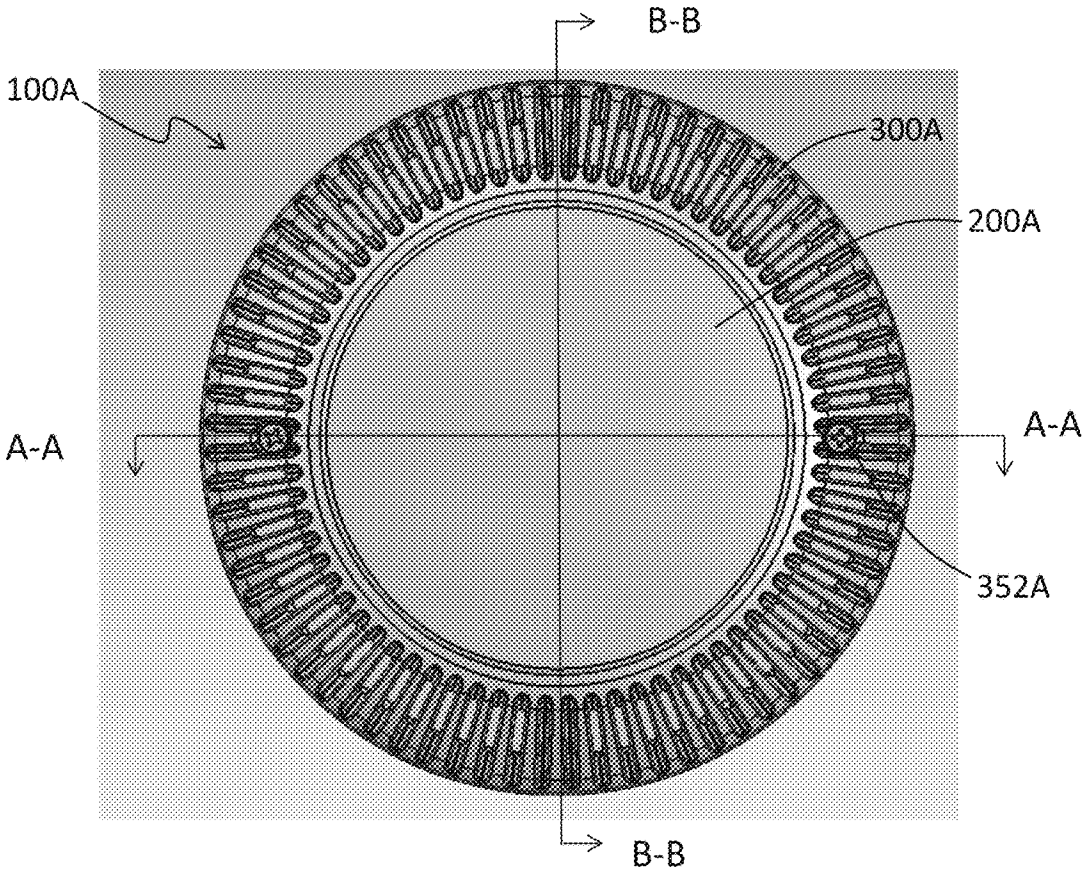
FIG. 18 is a top view of the drain cover assembly of FIG. 11, illustrating the planes of cross-section for FIGS. 18A and 18B.
Figure 18A:
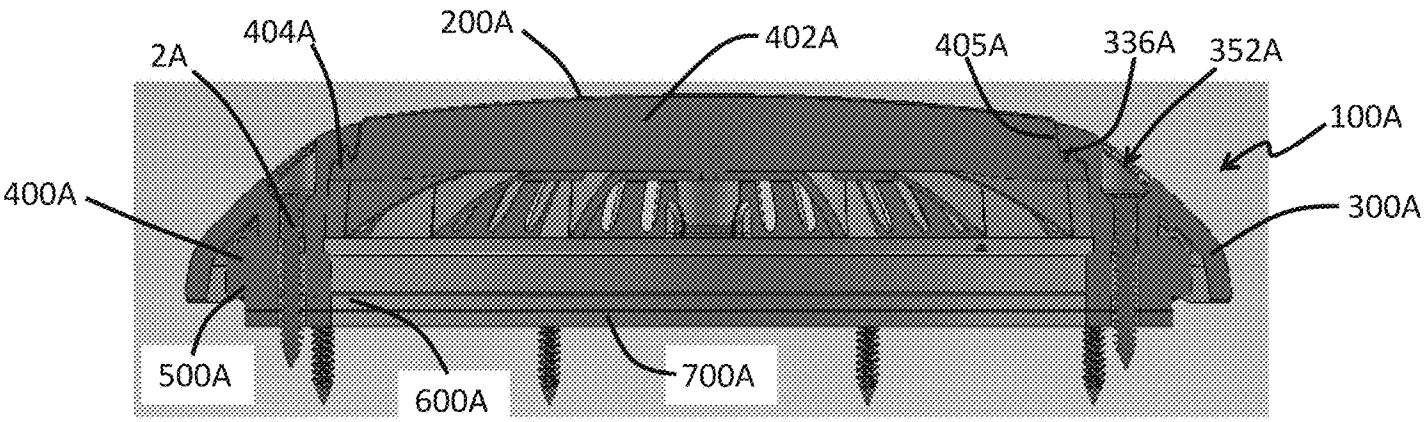
FIG. 18A is a side cross-sectional view of the drain cover assembly of FIG. 11 along the transverse plane A-A indicated in FIG. 18.
Figure 18B:
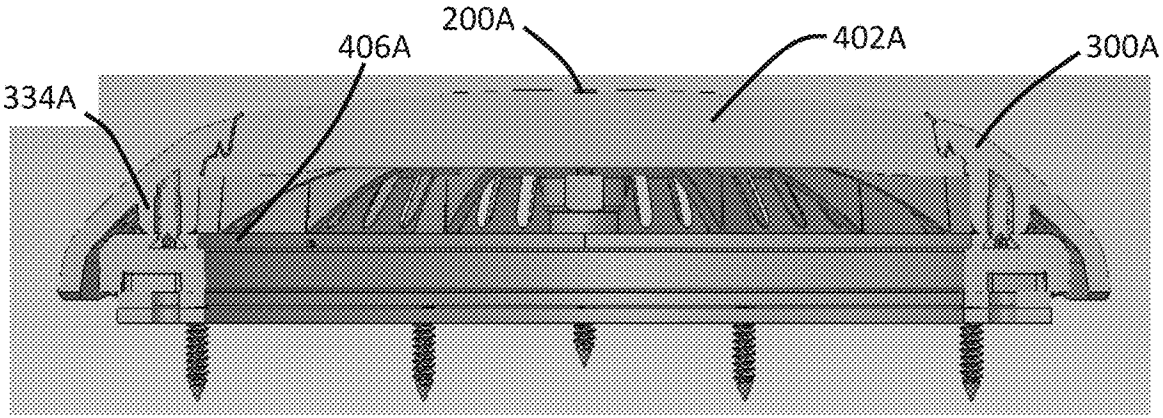
FIG. 18B is a side cross-sectional view of the drain cover assembly of FIG. 11 along the transverse plane B-B indicated in FIG. 18.

FIG. 18 is a top view of the drain cover assembly 100A shown in FIG. 11. FIG. 18A shows a cross-sectional view of the drain cover assembly 100A along a transverse plane that passes through the accesses 352A of the retainer ring 300A (as indicated in FIG. 18). FIG. 18B shows a cross-sectional view of the drain cover assembly 100A along a transverse plane that passes through the posts 334A of the retainer ring 300A (as indicated in FIG. 18). Referring to FIG. 18A, a fastener 2A can be passed through the access 352A of the retainer ring 300A and through the hole 416A (shown in FIG. 13A) of the support plate 400A to reach the ring hole 517A (shown in FIG. 15A) of the floor ring 500A. The ring hole 517A can include an internal thread that mates with the external thread of the fastener 2A, thereby allowing the fastener 2A to secure the floor ring 500A to the retainer ring 300A with the base ring 406A of the support plate 400 being interposed therebetween. The insert 200A can be pinched or pinned or otherwise secured between the ledge 404A of the cap 402A and the retainer ring 300A. Referring to FIG. 18B, a fastener (not shown) can be passed through a through hole of the base ring 406A of the support plate 400A and into the post 334A of the retainer ring 300A to secure the support plate 400A to the retainer ring 300A. The insert 200A can be pulled taut when the sidewall 405A moves longitudinally past the inner rim 336A of the retainer ring 300A as the cap 402A is secured to the retainer ring 300A.

Figure 19:
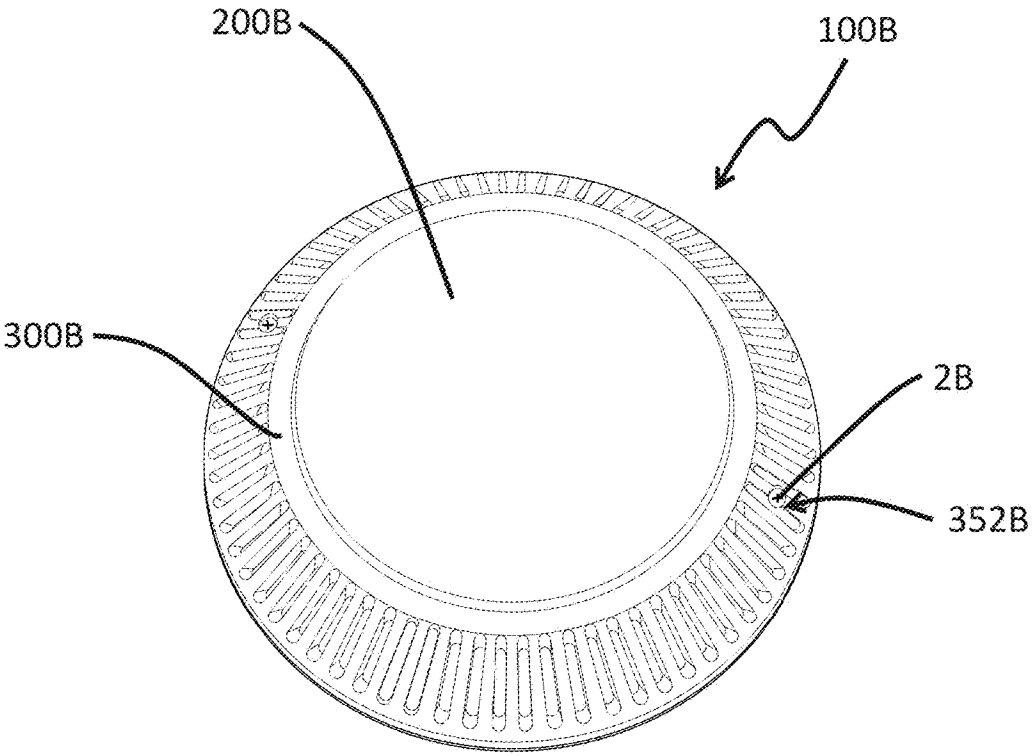
FIG. 19 is a partial top view of an embodiment of a vinyl pool drain cover assembly.

FIG. 19 shows a top view of a drain assembly 100B with an insert 200B installed. A fastener 2B is inserted through the access 352B of the retainer ring 300B to secure the retainer ring 300B to the floor ring (not shown). The insert 200B is pulled taut over the cap of the support plate.

Figure 20:
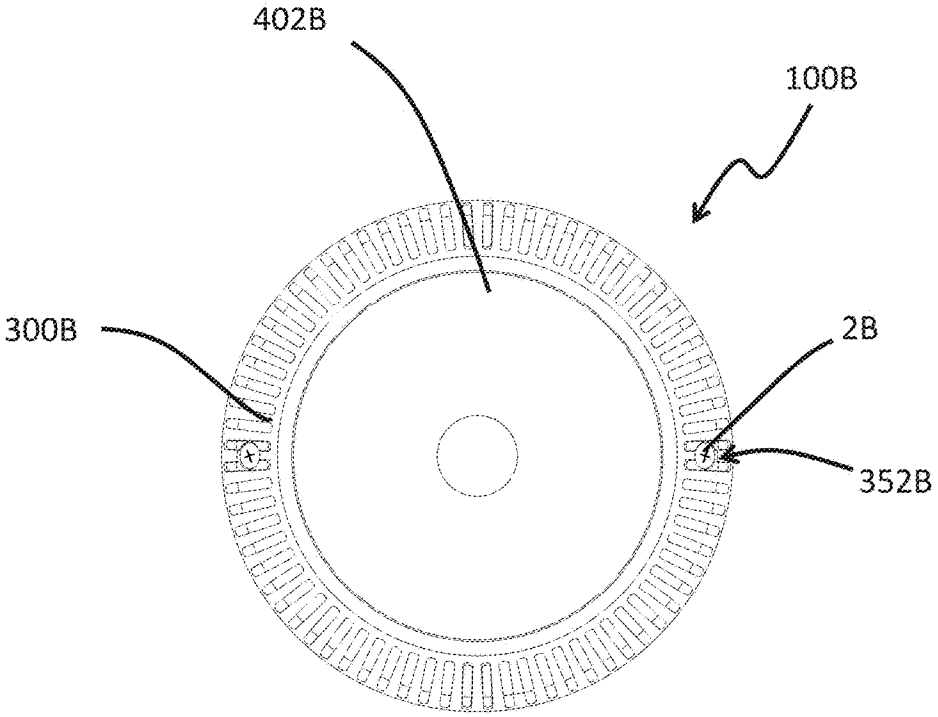
FIG. 20 is a top view of the embodiment of FIG. 19 without an insert.

FIG. 20 shows a top view of the drain assembly 100B of FIG. 19 with the insert removed to show the cap 402B of the support plate 400B.

Figure 21:
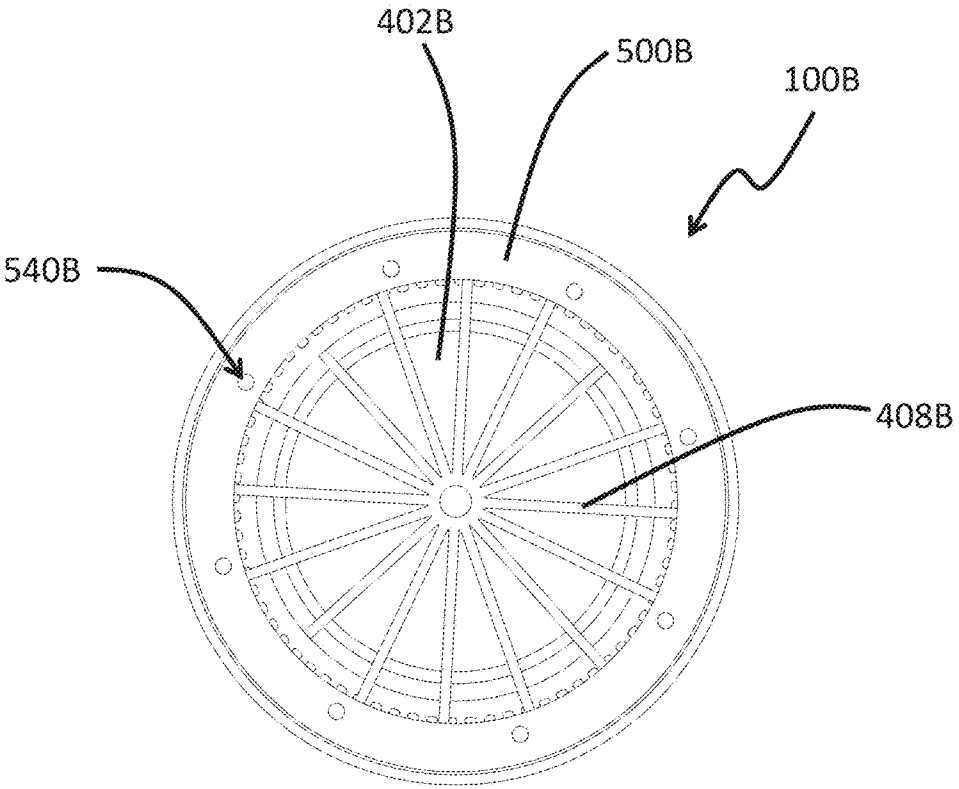
FIG. 21 is a bottom view of the embodiment of FIG. 19 without a top and bottom seal.

FIG. 21 shows a bottom view of the drain assembly 100B without the top or bottom seals 600, 700 in place.

Figure 22:
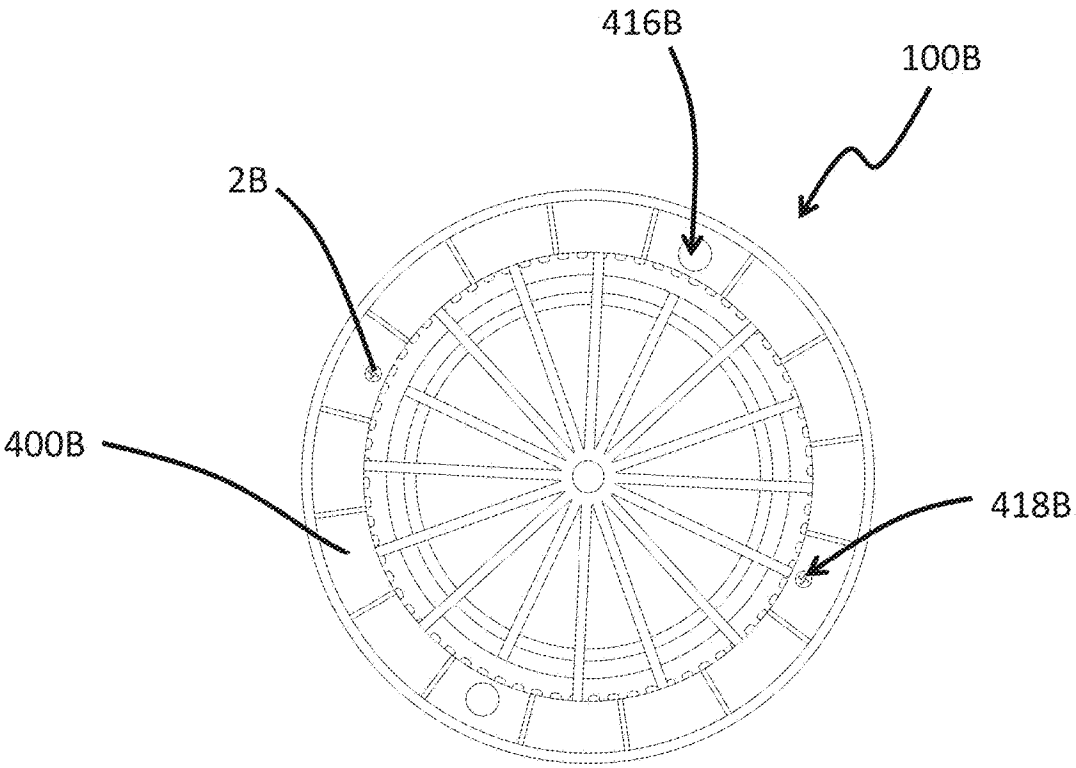
FIG. 22 is a partial top view a bottom view of the embodiment of FIG. 21 with the floor ring removed.

FIG. 22 shows a bottom view of the drain assembly 100B of FIG. 21 with the floor ring 500B removed to show the fastener 2B that passes through the aperture 418B of the support plate 400B to secure the support plate 400B to the retainer ring 300B.

Figure 23:
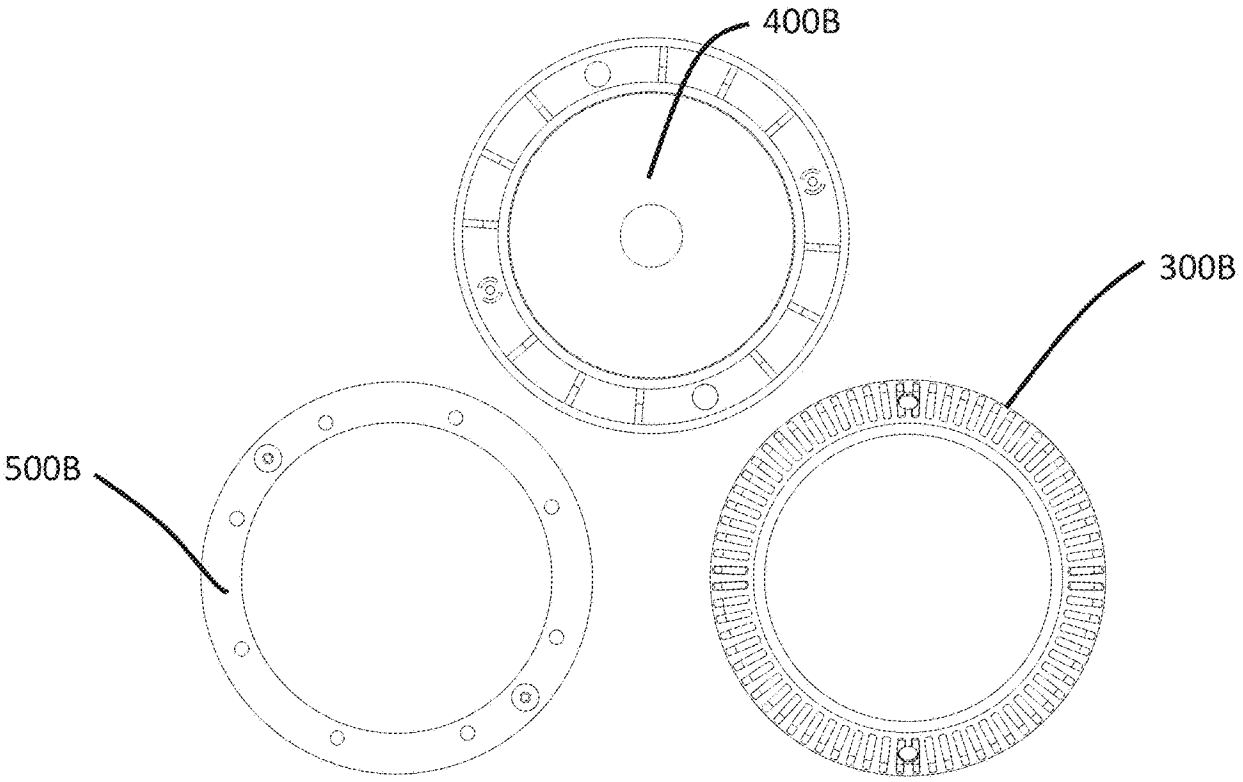
FIG. 23 is a partial top view of the floor ring, support plate, and retainer ring of the embodiment of FIG. 21.

FIG. 23 shows a top view of the disassembled retainer ring 300B, support plate 400B, and floor ring 500B of the drain assembly 100B shown in FIG. 20.

Figure 24:
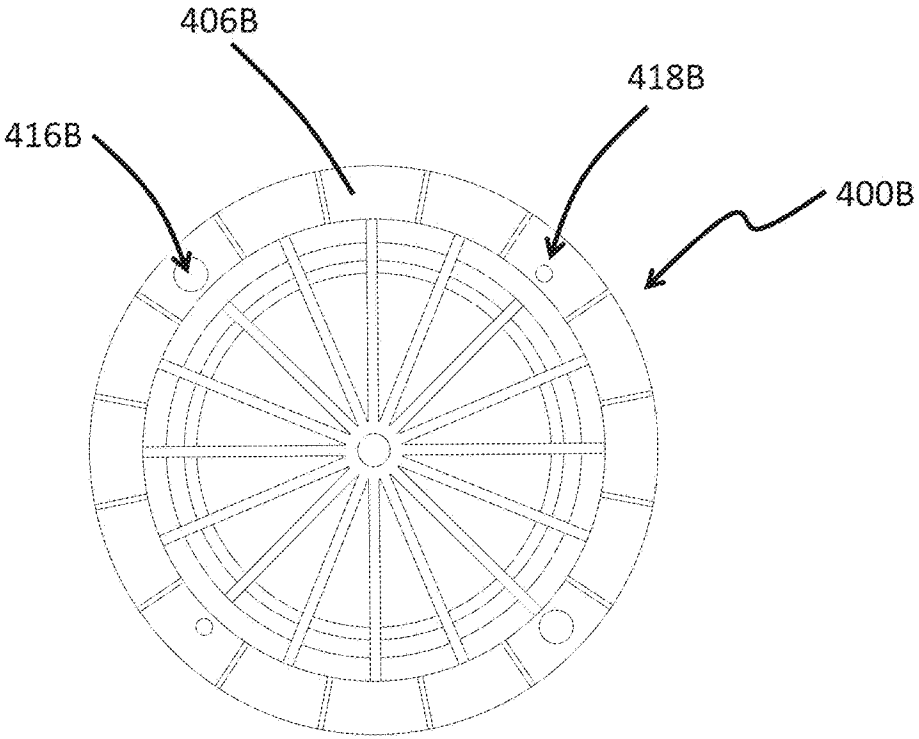
FIG. 24 is a bottom view of an embodiment of a support plate.

FIG. 24 shows a bottom view of the support plate 400B shown in FIG. 23.

Figure 25:
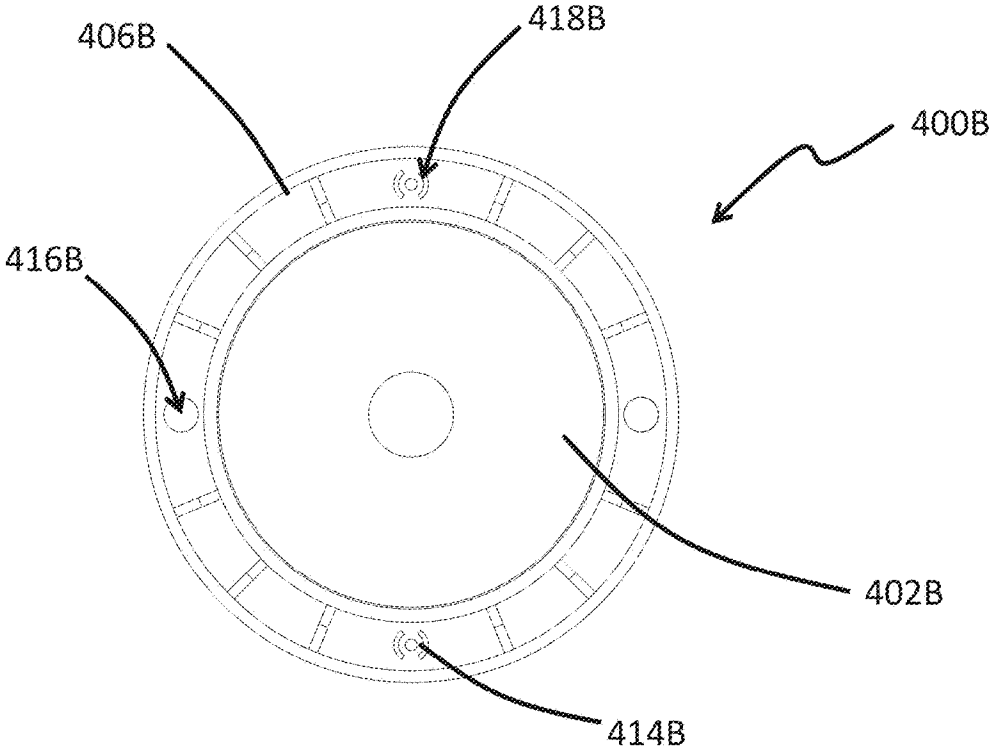
FIG. 25 is a top view of the embodiment of the support plate of FIG. 24.

FIG. 25 shows a top view of the support plate 400B shown in FIG. 23.

Figure 26:
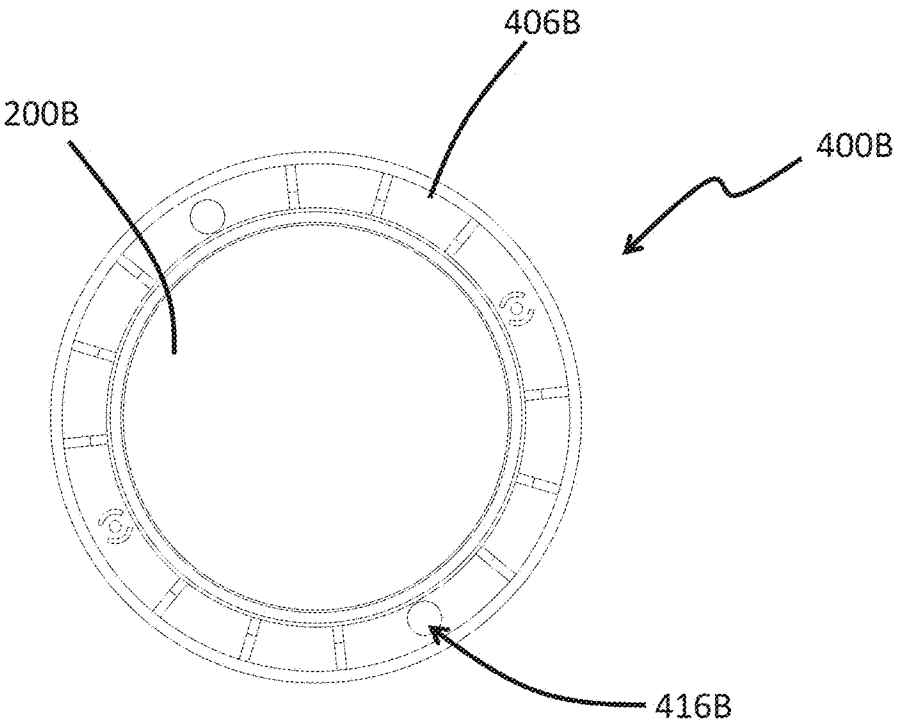
FIG. 26 is a top view of the embodiment of the support plate of FIG. 25 showing a vinyl insert covering the cap of the support plate.

FIG. 26 shows a top view of the support plate 400B shown in FIG. 25 with an insert 200B covering the cap 402B of the support plate 400B.

Figure 27:
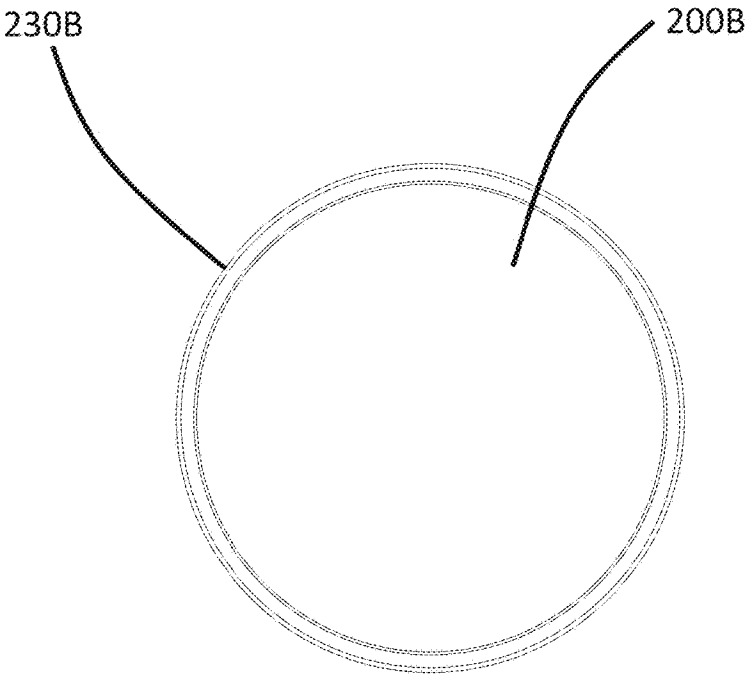
FIG. 27 is a top view of an embodiment of a vinyl insert cut to fit in the vinyl pool drain cover assembly.

FIG. 27 is a top view of the insert 200B shown in FIG. 26.

Figure 28:
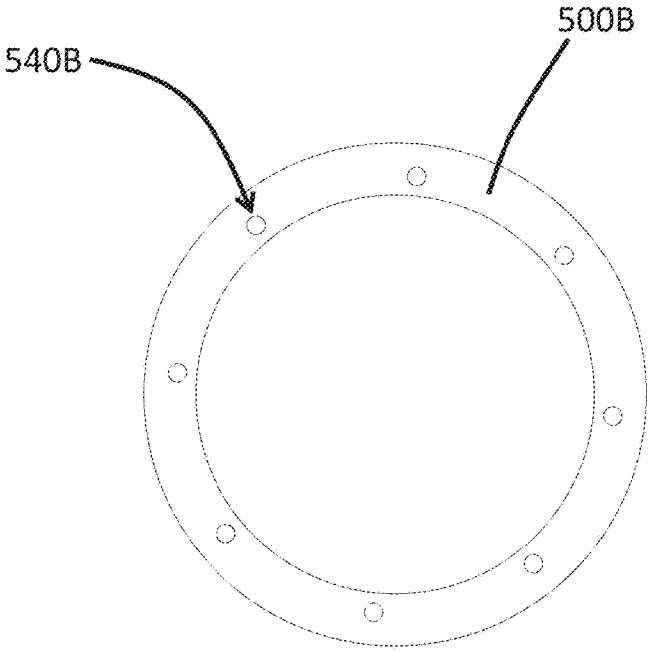
FIG. 28 is a bottom view of an embodiment of the floor ring.

FIG. 28 is a bottom view of the floor ring 500B shown in FIG. 23.

Figure 29:
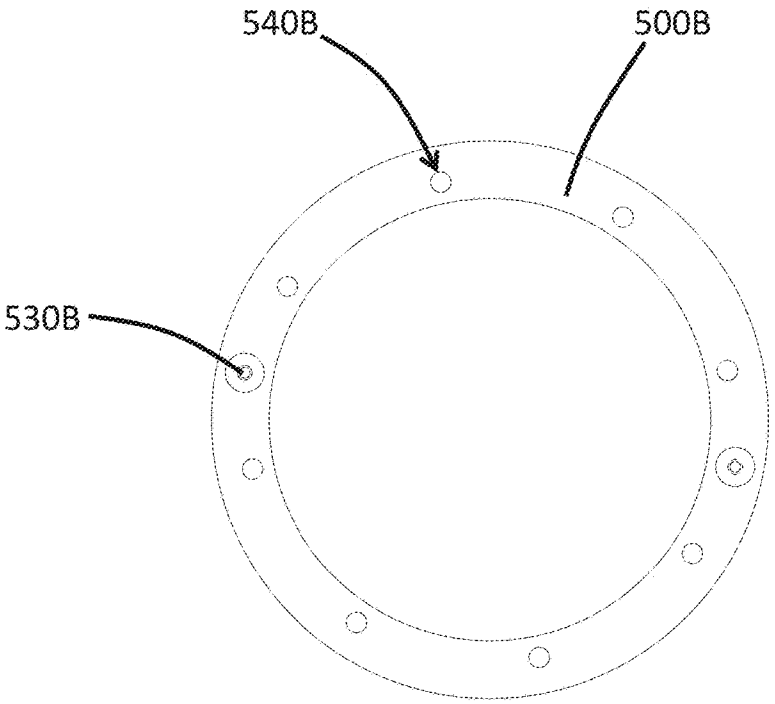
FIG. 29 is a top view of the embodiment of the floor ring of FIG. 28.

FIG. 29 is a top view of the floor ring 500B shown in FIG. 28, illustrating that the post 530B can include an internal thread.

Figure 30:
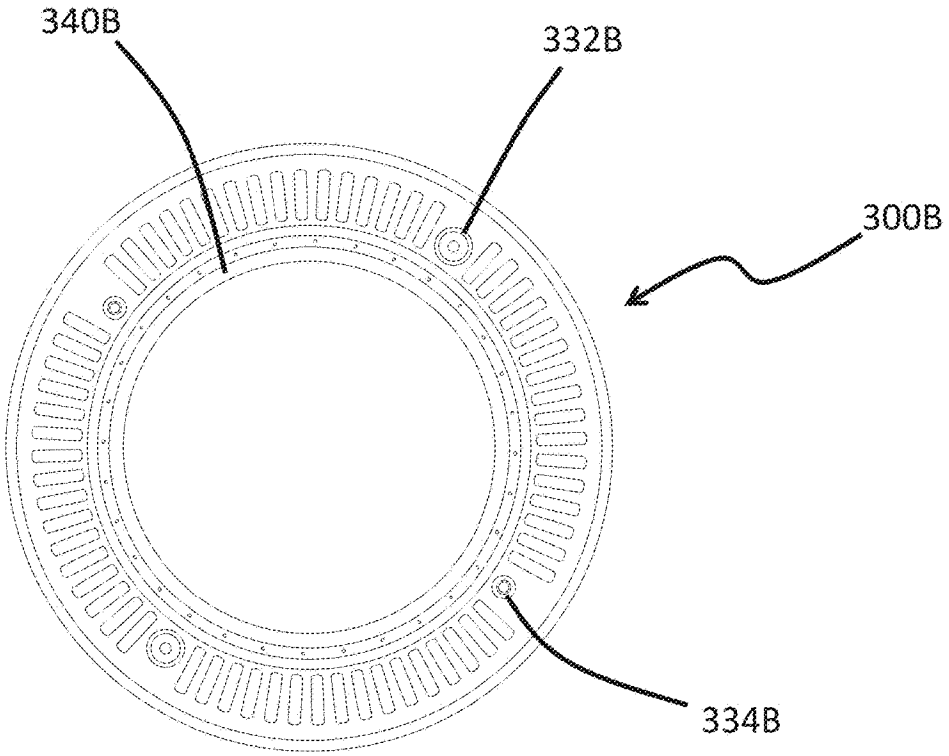
FIG. 30 is a bottom view of an embodiment of the retainer ring.

FIG. 30 is a bottom view of the retainer ring 300B shown in FIG. 23, illustrating that the post 334B can include an internal thread.

Figure 31:
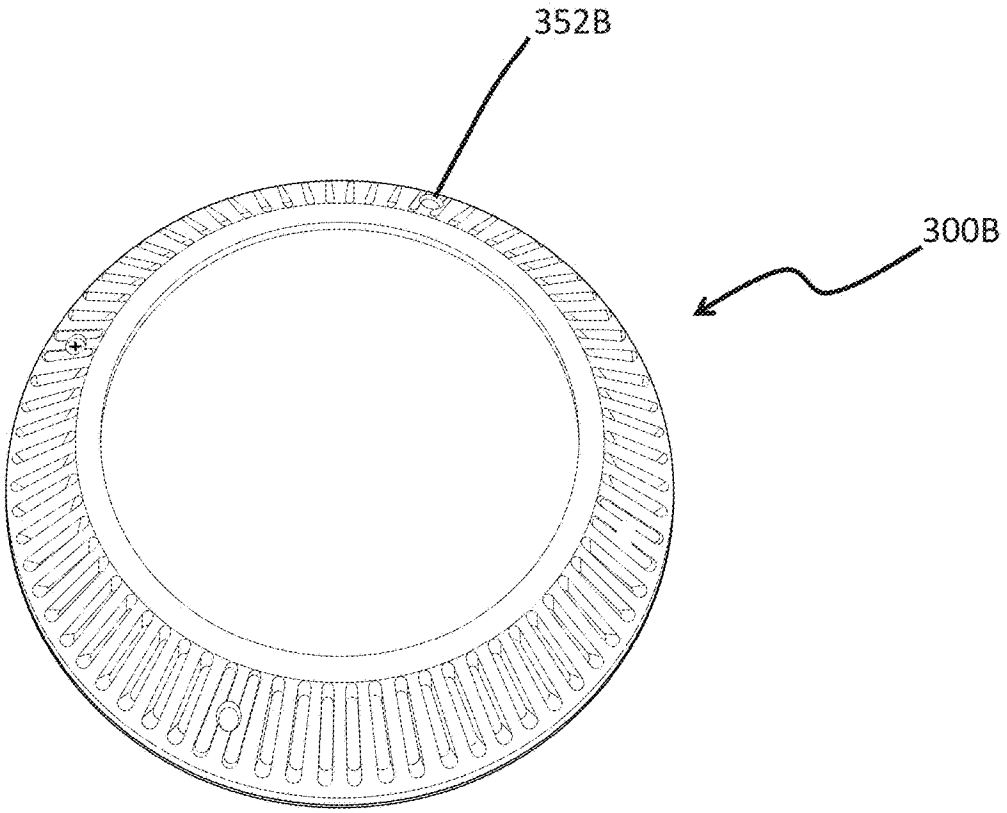
FIG. 31 is a top view of the embodiment of the retainer ring of FIG. 30.

FIG. 31 is a top view of the retainer ring 300B shown in FIG. 30.

Figure 32:
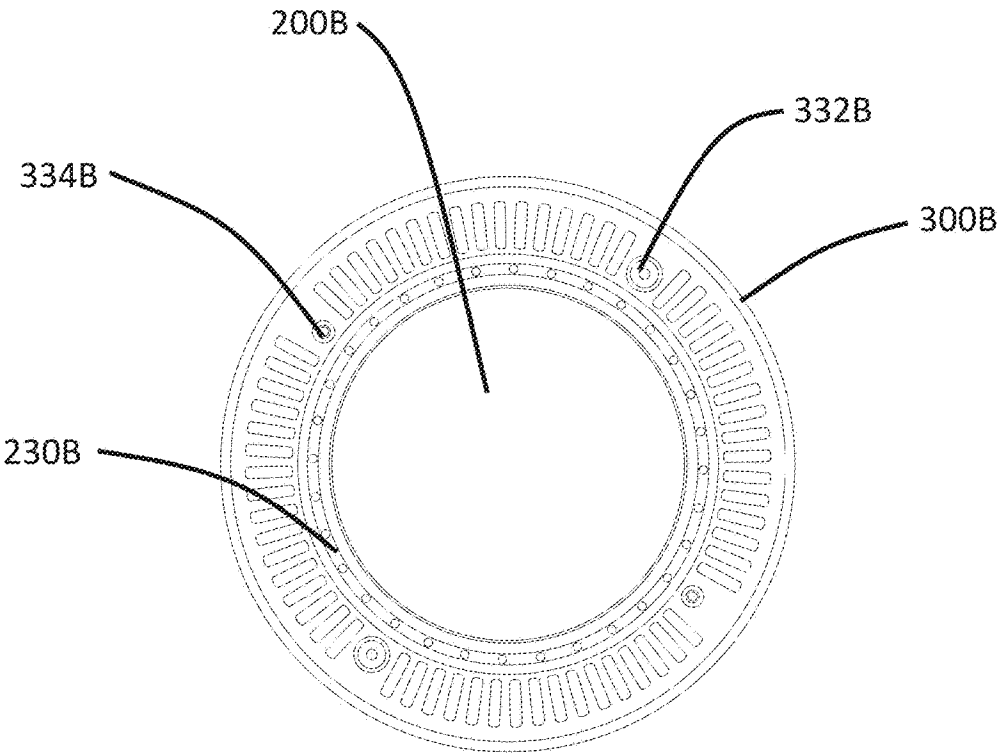
FIG. 32 is a bottom view of the retainer ring of FIG. 30 with the vinyl insert attached to the retainer ring.

FIG. 32 is a bottom view of the retainer ring 300B shown in FIG. 30 with the flange 230 of the insert 200B mounted on the annular groove 340B (shown in FIG. 30) of the retainer ring 300B.

Certain Terminology

Although the drain cover assemblies have been disclosed in the context of certain embodiments and examples, it will be understood by those skilled in the art that the assemblies extend beyond the specifically disclosed embodiments to other alternative embodiments and/or uses of the embodiments and certain modifications and equivalents thereof. For example, although drain cover assemblies having a retainer ring with a substantially constant inner diameter are depicted in some of the figures, the disclosed inventive concepts can be used in connection with a retainer ring that includes a plurality of tabs that extend from the inner rim of the retainer ring. For another example, an intermediate structure can be fitted between the retainer ring and the cap portion of the support plate, with the insert being secured between the intermediate structure and the support plate and/or the retainer ring.

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

Summary

In summary, various embodiments and examples of assemblies have been disclosed. Although the assemblies have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

What is claimed is:

1. A drain cover assembly adapted to be positioned over a drain opening, the drain cover assembly comprising:

a retainer ring comprising an inner rim that circumferentially surrounds a central opening, the retainer ring comprising a plurality of openings through which water can pass to reach the drain opening;

a support plate comprising a central portion and a peripheral flange coupled to the central portion, the peripheral flange circumferentially surrounds the central portion, the peripheral flange having an outer diameter larger than an inner diameter of the central opening; and a removable insert disposed over the central portion of the support plate, said removable insert comprising a flexible, stretchable liner material, wherein a peripheral portion of the removable insert is secured between the support plate and the retainer ring.

2. The drain cover assembly of claim 1, wherein the support plate further comprises a sidewall interposed between the central portion and the peripheral flange.

3. The drain cover assembly of claim 2 wherein at least a portion of the removable insert is interposed between the inner rim and the sidewall when the drain cover assembly is assembled.

4. The drain cover assembly of claim 1, wherein at least a portion of the central portion protrudes through the central opening when the drain cover assembly is assembled.

5. The drain cover assembly of claim 1 further comprising a base ring connected to the support plate, the base ring comprising a plurality of struts that extend radially inward from the base ring.

6. The drain cover assembly of claim 5 wherein the base ring comprises a clip or a hole adapted to reversibly attach the base ring to the retainer ring.

7. The drain cover assembly of claim 5 wherein the support plate rests on the plurality of struts when the drain cover assembly is assembled and the plurality of struts support the support plate.

8. The drain cover assembly of claim 7, wherein the support plate is fixedly attached to the plurality of struts.

9. The drain cover assembly of claim 5, further comprising a floor ring adapted to reversibly attach to the retainer ring, wherein the base ring is disposed between the floor ring and the retainer ring when the retainer ring is attached to the floor ring.

10. The drain cover assembly of claim 9, wherein the floor ring comprises a plurality of through holes and one or more posts extending from a top surface of the floor ring.

11. The drain cover assembly of claim 10, wherein the base ring comprises at least one through hole sized to allow the post of the floor ring to pass through the at least one through hole of the base ring.

12. The drain cover assembly of claim 9, further comprising a top seal and a bottom seal, the top seal disposed between the bottom seal and the floor ring when the drain cover assembly is assembled, each of the top seal and the bottom seal comprising at least one through hole adapted to align with the at least one through hole of the floor ring.

13. The drain cover assembly of claim 1, wherein the flexible, stretchable liner material comprises vinyl.

14. The drain cover assembly of claim 1, wherein the peripheral portion is secured to one or both of the retainer ring and the support plate by an adhesive.

15. The drain cover assembly of claim 1, wherein the peripheral flange comprises one or more pins adapted to align with one or more recesses disposed on the retainer ring.

16. The drain cover assembly of claim 1, wherein the retainer ring comprises one or more pins adapted to align with one or more recesses disposed on the peripheral flange.

* * * * *